US009643622B2

(12) United States Patent
Maeyama et al.

(10) Patent No.: US 9,643,622 B2
(45) Date of Patent: May 9, 2017

(54) TRACK-GUIDED VEHICLE, AND CAR BODY TILT CONTROL METHOD THEREFOR

(71) Applicant: MITSUBISHI HEAVY INDUSTRIES, LTD., Tokyo (JP)

(72) Inventors: Hiroyuki Maeyama, Tokyo (JP); So Tamura, Tokyo (JP); Kousuke Katahira, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 14/760,129

(22) PCT Filed: Feb. 21, 2013

(86) PCT No.: PCT/JP2013/054370
§ 371 (c)(1),
(2) Date: Jul. 9, 2015

(87) PCT Pub. No.: WO2014/128889
PCT Pub. Date: Aug. 28, 2014

(65) Prior Publication Data

US 2015/0353104 A1 Dec. 10, 2015

(51) Int. Cl.
*B61F 13/00* (2006.01)
*B61F 5/50* (2006.01)
(Continued)

(52) U.S. Cl.
CPC ..... *B61B 13/00* (2013.01); *B61F 5/22* (2013.01); *B61F 5/50* (2013.01); *B61F 9/00* (2013.01)

(58) Field of Classification Search
None
See application file for complete search history.

(56) References Cited

U.S. PATENT DOCUMENTS 3,688,704 A * 9/1972 Strohmer ..... B61F 5/22 105/453
3,789,769 A * 2/1974 Strohmer ..... B61F 5/22 105/164
(Continued)

FOREIGN PATENT DOCUMENTS

JP S45-024403 B 8/1970
JP H06-056034 A 3/1994
(Continued)

OTHER PUBLICATIONS

PCT/ISA/210, "International Search Report for International Application No. PCT/JP2013/054370," May 14, 2013.
(Continued)

*Primary Examiner* — Krishnan Ramesh
(74) *Attorney, Agent, or Firm* — Manabu Kanesaka; Benjamin Hautman; Kenneth Berner

(57) ABSTRACT

This track-guided vehicle is provided with a car body, and a bogie that supports the car body from the bottom, and has a frame capable of pivoting around an axis perpendicular to a track. The bogie is provided with: a car body tilting part that tilts the car body to the left and right in the direction of travel; a detection part that detects the amount of pivot of the frame; and a tilt control part that allows the car body to be tilted by the car body tilting part on the basis of the amount of pivot detected by the detection part.

15 Claims, 23 Drawing Sheets

(51) Int. Cl.

| | |
|---|---|
| ***B61F 5/22*** | (2006.01) |
| ***B61F 9/00*** | (2006.01) |
| ***B61B 13/00*** | (2006.01) |

(56) References Cited

U.S. PATENT DOCUMENTS

| | | | | |
|---|---|---|---|---|
| 4,132,174 | A * | 1/1979 | Ziegenfus | B61B 13/125 104/166 |
| 5,590,603 | A * | 1/1997 | Lund | B61B 13/00 104/124 |
| 5,590,604 | A * | 1/1997 | Lund | B61B 13/00 104/124 |
| 5,598,783 | A * | 2/1997 | Lund | B61B 13/00 104/124 |
| 5,706,735 | A * | 1/1998 | Lund | B61B 13/00 104/130.07 |
| 6,161,064 | A * | 12/2000 | Strasser | B61D 3/10 105/3 |
| 6,484,074 | B1 * | 11/2002 | Hazard | B61F 5/22 105/199.2 |
| 7,957,866 | B2 * | 6/2011 | Oba | B66F 11/04 180/412 |
| 8,249,776 | B2 * | 8/2012 | Reimann | B61F 5/383 701/19 |
| 2009/0276107 | A1 * | 11/2009 | Reimann | B61F 5/383 701/19 |
| 2012/0000391 | A1 | 1/2012 | Maeyama et al. | |

FOREIGN PATENT DOCUMENTS

| | | | |
|---|---|---|---|
| JP | H06-270806 | A | 9/1994 |
| JP | H10-236305 | A | 9/1998 |
| JP | 2000-006805 | A | 1/2000 |
| JP | 2003-252202 | A | 9/2003 |
| JP | 2004-009895 | A | 1/2004 |
| JP | 2005-035321 | A | 2/2005 |
| JP | 2008-239043 | A | 10/2008 |
| JP | 2010-173354 | A | 8/2010 |
| JP | 2010-188958 | A | 9/2010 |
| JP | 2010-188971 | A | 9/2010 |
| JP | 2010-195057 | A | 9/2010 |
| JP | 2010-215120 | A | 9/2010 |
| JP | 2011-016441 | A | 1/2011 |
| JP | 2011-184027 | A | 9/2011 |
| JP | 2012-081920 | A | 4/2012 |
| JP | 2012-176657 | A | 9/2012 |
| JP | 2012-232718 | A | 11/2012 |

OTHER PUBLICATIONS

PCT/ISA/237, "Written Opinion of the International Searching Authority for International Application No. PCT/JP2013/054370," May 14, 2013.

Singapore Patent Office, "Office Action for SG 11201505382T," Jan. 11, 2016.

Japan Patent Office, "Decision of Rejection for Japanese Patent Application No. 2015-501161," Aug. 16, 2016.

* cited by examiner

TRACK-GUIDED VEHICLE, AND CAR BODY TILT CONTROL METHOD THEREFOR

RELATED APPLICATIONS

The present application is National Phase of International Application No. PCT/JP2013/054370 filed Feb. 21, 2013, the disclosure of which is hereby incorporated by reference herein in its entirety.

TECHNICAL FIELD

The present invention relates to a guide-rail track vehicle that can travel along a track, and particularly, to a guide-rail track vehicle that can tilt a car body toward an inner rail and a car body tilt control method therefor.

BACKGROUND ART

A railway-based transportation system, which can travel on a track via travelling wheels with rubber tires, is known as a new transportation system other than a bus or a train. Typically, this type of railway-based transportation system is referred to as a "new transportation system" or an "automated people mover (APM)". In the railway-based transportation system, guide wheels disposed respectively in the opposite side portions of a vehicle are guided by guide rails provided along the track.

In many cases, the vehicle of the railway-based transportation system has a car body length shorter than that of a typical train vehicle, and thereby, similar to an automobile or a bus, the vehicle includes single-axle bogies at the front and rear of the car body, respectively. In addition, in many cases, when the single-axle bogies are used in the vehicle of the railway-based transportation system, a parallel link method similar to an automobile or the like is adopted for a simple suspension mechanism. In the vehicle of the railway-based transportation system, air springs may be provided between the car body and the bogie so as to absorb roughness of the track and improve ride quality.

The vehicle of the railway-based transportation system is required to enable increased travel speed such that a movement time is reduced or transportation capacity is increased. However, since an unbalanced centrifugal force increases corresponding to an increase in travel speed when the vehicle travels on a curved portion of the track, ride quality and safety may deteriorate.

A typical train vehicle, which includes a car body tilting apparatus configured to tilt a car body inward of the track so as to counteract an unbalanced centrifugal force generated in the curved portion, has been put into practice.

For example, in a technology disclosed in PTLs 1 to 5, the car body is tilted toward the inner rail by setting the respective lengths of a pair of right and left air springs to be different from each other using a height adjustment mechanism of the air springs. According to this technology with a simple configuration, it is possible to tilt the vehicle toward the inner rail.

CITATION LIST

Patent Literature

[PTL 1] Japanese Unexamined Patent Application Publication No. 2012-232718

[PTL 2] Japanese Unexamined Patent Application Publication No. 2012-176657

[PTL 3] Japanese Unexamined Patent Application Publication No. 2011-016441

[PTL 4] Japanese Unexamined Patent Application Publication No. 2010-173354

[PTL 5] Japanese Unexamined Patent Application Publication No. 2011-184027

SUMMARY OF INVENTION

Technical Problem

In a case where the tilting of the vehicle is performed using the air springs, based on a pre-set operation plan (run curve), the position of a host vehicle, and the like, it is necessary to start control of supply and discharge of air to and from the air springs when the guide-rail track vehicle enters the curved portion of the track. For this reason, it is necessary to accurately detect the position of a host vehicle. However, in a case where variances in detecting the position of a host vehicle occur, regardless of when the guide-rail track vehicle enters the curved portion, the car body may not be tilted toward the inner rail but be tilted toward an outer rail due to centrifugal force. In this case, passengers feel acceleration greater than that induced by an actual centrifugal force, and thereby the passengers may experience deteriorated ride quality.

In order to prevent the car body from being tilted toward the outer rail, the vehicle may be provided with an anti-rolling apparatus that is configured to prevent the car body from being tilted in a rolling direction by increasing rolling rigidity when the vehicle enters the curved portion of the track. However, when the tilting of the car body is prevented by increasing the rolling rigidity, vibration induced by roughness of a travel path is transmitted to the car body, and ride quality may deteriorate.

A car body tilting mechanism with the adoption of a pendulum needle method may be used in a typical train vehicle so as to counteract an unbalanced centrifugal force. However, when the car body tilting mechanism with the adoption of the pendulum needle method is adopted in the vehicle of the railway-based transportation system, the size of the bogie may become excessively large compared to that of the car body. For this reason, the center of gravity of the car body is positioned at a high location, and thereby there may be no improvement in ride quality.

An object of the present invention is to provide a guide-rail track vehicle and a car body tilt control method therefor in which deterioration in ride quality can be very reliably prevented when the guide-rail track vehicle travels on a curved portion of a track.

Solution to Problem

According to a first aspect of the present invention, there is provided a guide-rail track vehicle including a car body and a bogie configured to support the bottom of the car body. The bogie includes a car body tilting mechanism configured to tilt the car body in a vehicle lateral direction, and a guiding frame configured to turn while being guided by guide rails provided along a track. The bogie further includes a detection unit configured to detect the degree of turning of the guiding frame, and a tilt control unit configured to control the car body tilting mechanism to tilt the car body based on a detection result from the detection unit.

According to a second aspect of the present invention, in the guide-rail track vehicle of the first aspect, the detection unit may include a link mechanism configured to convert a displacement of the guiding frame in a turn direction into a linear displacement, and a displacement sensor configured to detect the linear displacement converted by the link mechanism.

According to a third aspect of the present invention, the guide-rail track vehicle of the first or second aspect may further include dampening apparatuses that are disposed between the bogie and the car body while being separate from each other in the vehicle lateral direction; a height adjustment apparatus configured to be able to individually adjust the height of each of the dampening apparatuses; and an automatic height adjustment mechanism configured to maintain the height of the dampening apparatus in a pre-set range of height by operating the height adjustment apparatus. The car body tilting mechanism may include a height adjustment apparatus moving mechanism configured to be able to move the height adjustment apparatus in a height direction, and a drive apparatus configured to drive the height adjustment apparatus moving mechanism. In addition, the tilt control unit may control the driving of the drive apparatus based on a detection result from the detection unit, and move the position of the height adjustment apparatus in the height direction using the height adjustment apparatus moving mechanism.

According to a fourth aspect of the present invention, the guide-rail track vehicle of the first or second aspect may further include dampening apparatuses that are disposed between the bogie and the car body while being separate from each other in the vehicle lateral direction; a height adjustment apparatus configured to be able to individually adjust the height of each of the dampening apparatuses; and an automatic height adjustment mechanism configured to maintain the height of the dampening apparatus in a pre-set range of height by operating the height adjustment apparatus. The car body tilting mechanism may include a tilt angle control apparatus that is configured to change the height of the dampening apparatus while bypassing the height adjustment apparatus, when tilting the car body, and a tilt adjustment apparatus configured to restrict the height adjustment apparatus from adjusting the height of the dampening apparatus. In addition, the tilt control unit may control the driving of the tilt angle control apparatus based on a detection result from the detection unit such that the height of the dampening apparatus is adjusted.

According to a fifth aspect of the present invention, the guide-rail track vehicle of the first or second aspect may further include dampening apparatuses that are disposed between the bogie and the car body while being separate from each other in the vehicle lateral direction; a height adjustment apparatus configured to be able to individually adjust the height of each of the dampening apparatuses; and an automatic height adjustment mechanism configured to maintain the height of the dampening apparatus in a pre-set range of height by operating the height adjustment apparatus. The car body tilting mechanism may include a car body lifting up and down apparatus that is configured to support the bottom of the dampening apparatus and to be able to move the position of the dampening apparatus in a vertical direction, and a tilt adjustment apparatus configured to restrict the height adjustment apparatus from adjusting the height of the dampening apparatus. In addition, the tilt control unit may control the car body lifting up and down apparatus to displace the position of the dampening apparatus in the vertical direction based on a detection result from the detection unit.

According to a sixth aspect of the present invention, the guide-rail track vehicle of the first or second aspect may further include dampening apparatuses that are disposed between the bogie and the car body while being separate from each other in the vehicle lateral direction; and an anti-rolling apparatus that is configured to include a torsion bar extending in the vehicle lateral direction, and to restrict the tilting of the car body using a restoring force of the torsion bar in a torsional direction. The car body tilting mechanism may include a rod expansion and contraction apparatus configured to displace a neutral position of the torsion bar in the torsional direction. In addition, the tilt control unit may control the driving of the rod expansion and contraction apparatus based on a detection result from the detection unit such that the neutral position of the torsion bar is displaced.

According to a seventh aspect of the present invention, the guide-rail track vehicle of the fifth or sixth aspect may further include dampening apparatuses that are disposed between the bogie and the car body while being separate from each other in the vehicle lateral direction. The bogie may include a suspension frame fixed to a floor portion of the car body. The car body tilting mechanism may include a right/left stopper that is disposed in a lateral center portion of the floor portion of the car body and is configured to restrict the car body from being slid in the vehicle lateral direction while allowing the car body to be tilted in the vehicle lateral direction, and a car body tilting drive apparatus configured to apply force to the suspension frame in the vehicle lateral direction. In addition, the tilt control unit may control the driving of the car body tilting drive apparatus based on a detection result from the detection unit such that force is applied to the suspension frame in the vehicle lateral direction.

According to an eighth aspect of the present invention, in the guide-rail track vehicle of any one of the first to seventh aspects, the tilt control unit may include a running condition acquisition unit configured to acquire at least vehicle speed information as a running condition, and a curvature radius calculation unit configured to calculate the curvature radius of the track based on the degree of turning detected by the detection unit. The tilt control unit may further include a normal acceleration calculation unit configured to obtain normal lateral acceleration applied to passengers in the vehicle based on the vehicle speed information and the curvature radius, and a tilt angle calculation unit configured to calculate the lateral tilt angle of the car body based on the normal lateral acceleration.

According to a ninth aspect of the present invention, the guide-rail track vehicle of the eighth aspect may further include a speed detection unit configured to detect a vehicle speed. The running condition acquisition unit may acquire vehicle speed information from the speed detection unit. In addition, the normal acceleration calculation unit may calculate normal lateral acceleration based on information regarding the vehicle speed and the curvature radius.

According to a tenth aspect of the present invention, the tilt control unit of the guide-rail track vehicle of the eighth aspect may further include a storage unit configured to pre-store information regarding the cant of the track and the vehicle speed. The running condition acquisition unit may acquire information regarding the cant and the vehicle speed from information stored in the storage unit. In addition, the normal acceleration calculation unit may calculate normal lateral acceleration based on information regarding the cant, the vehicle speed, and the curvature radius.

According to an eleventh aspect of the present invention, the guide-rail track vehicle of the tenth aspect may further include an acceleration detection unit configured to detect normal lateral acceleration. The running condition acquisition unit may acquire information regarding the normal lateral acceleration detected by the acceleration detection unit. In addition, the tilt control unit may include an acceleration comparison unit that is configured to compare the normal lateral acceleration calculated by the normal acceleration calculation unit with the normal lateral acceleration detected by the acceleration detection unit.

According to a twelfth aspect of the present invention, there is provided a car body tilt control method of a guide-rail track vehicle including a guiding frame that is configured to turn while being guided by guide rails provided along a track, the method including: a detection step of detecting the degree of turning of the guiding frame; and a tilt control step of controlling the tilting of a car body based on the degree of turning of the guiding frame.

According to a thirteenth aspect of the present invention, in the car body tilt control method of a guide-rail track vehicle of the twelfth aspect, the tilt control step may include a running condition acquisition step of acquiring at least vehicle speed information as a running condition; a curvature radius calculation step of calculating the curvature radius of the track based on the degree of turning of the guiding frame; a normal acceleration calculation step of obtaining normal lateral acceleration applied to passengers in the vehicle based on the vehicle speed and the curvature radius; and a tilt angle calculation step of calculating the lateral tilt angle of the car body based on the normal lateral acceleration. The tilting of the car body may be controlled in such a manner that the tilt angle is equal to the calculated tilt angle.

According to fourteenth aspect of the present invention, in the car body tilt control method of a guide-rail track vehicle of the thirteenth aspect, information regarding a cant and the vehicle speed may be acquired in the running condition acquisition step, and the normal lateral acceleration may be calculated based on the cant, the vehicle speed, and the curvature radius in the normal acceleration calculation step.

According to a fifteenth aspect of the present invention, the car body tilt control method of a guide-rail track vehicle of the fourteenth aspect may further include an acceleration detection step of detecting normal lateral acceleration. Information regarding the normal lateral acceleration detected in the acceleration detection step may be acquired in the running condition acquisition step. The tilt control step may include an acceleration comparison step of comparing the normal lateral acceleration calculated in the normal acceleration calculation step with the normal lateral acceleration detected in the acceleration detection step.

Advantageous Effects of Invention

In the guide-rail track vehicle according to these aspects of the present invention, it is possible to more reliably prevent ride quality from deteriorating when the vehicle travels on a curved portion of the track.

DESCRIPTION OF EMBODIMENTS

Hereinafter, a guide-rail track vehicle 1 in a first embodiment of the present invention will be described.

Figure 1:
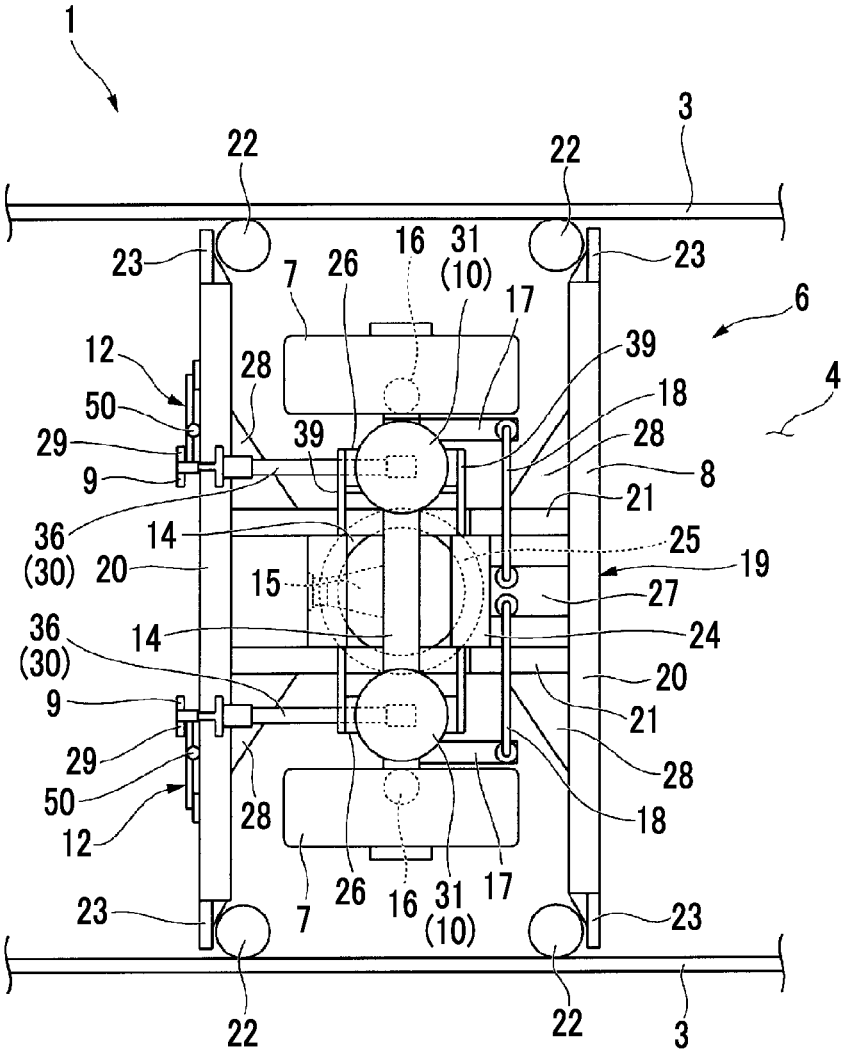
FIG. 1 is a plan view illustrating a bogie of a guide-rail track vehicle in an embodiment of the present invention.
Figure 2:
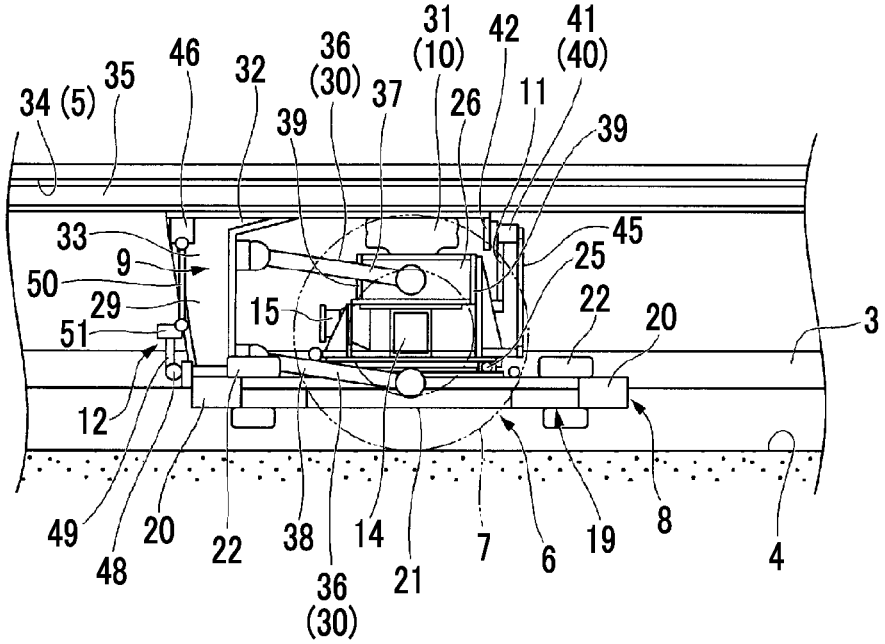
FIG. 2 is an enlarged side view of the bogie of the guide-rail track vehicle in the embodiment.
Figure 3:
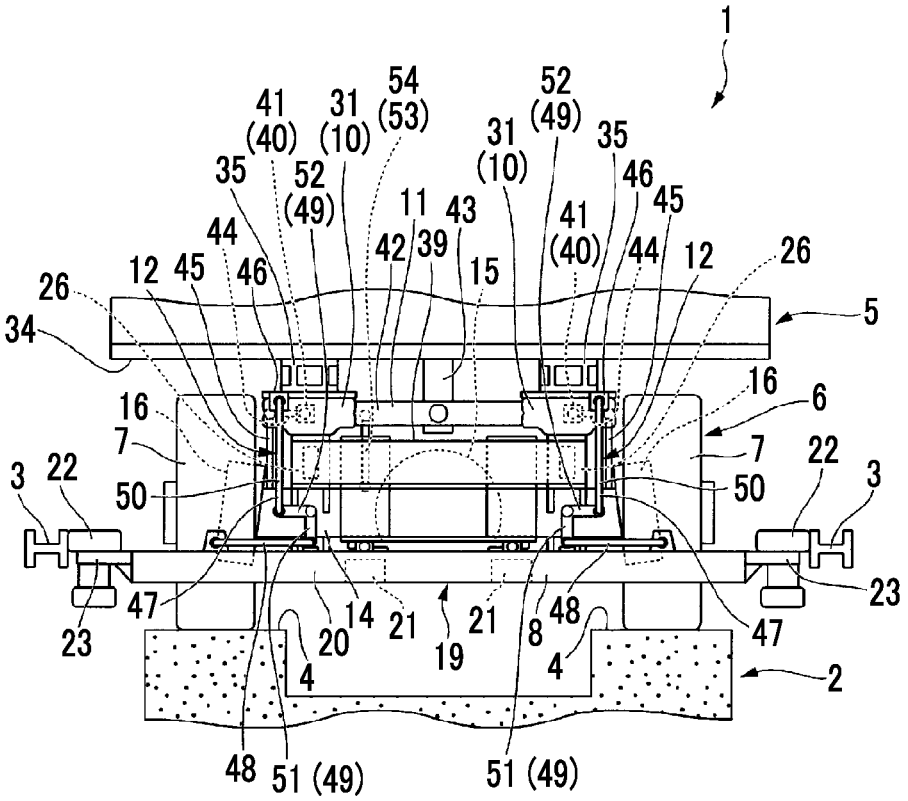
FIG. 3 is an enlarged front view of the bogie of the guide-rail track vehicle in the embodiment.

FIGS. 1 to 3 illustrate the guide-rail track vehicle 1 in the first embodiment. The guide-rail track vehicle 1 in the first embodiment travels on a travel path 4 while being guided by guide rails 3 which are so-called side guide rails and are disposed respectively in the opposite lateral side portions of a track 2.

As illustrated in FIGS. 1 to 3, the guide-rail track vehicle 1 includes a car body 5 and a bogie 6.

The car body 5 (refer to FIGS. 2 and 3) is formed in a rectangular parallelepiped hollow shape which is long in a longitudinal direction. The inner space of the car body 5 acts as a space for accommodating passengers.

The bogies 6 can travel on the travel path 4, and support bottoms of front and rear portions of the car body 5, respectively. The bogie 6 includes a pair of travelling wheels 7; a steering device 8; a suspension apparatus 9; a dampening apparatus 10; a car body tilting mechanism 11; a detection unit 12; and a tilt control unit (refer to FIG. 4). Since the only difference between the bogies 6 is that one is disposed in the front portion of the car body 5 and the other is disposed in the rear portion of the car body 5, hereinbelow, only the bogie 6 disposed in the front portion will be described (hereinafter, only the bogie 6 disposed in the front portion will be described also in second to fifth embodiments).

The pair of travelling wheels 7 is tired wheels with rubber tires. The travelling wheels 7 are linked to a drive apparatus 15 such as a gear box via an axle 14 extending inward in a vehicle lateral direction. A drive force is transmitted from the drive apparatus 15 to the travelling wheels 7 via the axle 14. The travelling wheels 7 are supported in such a manner so as to be able to swing about kingpins 16 disposed respectively in the opposite lateral end portions of a bogie frame (not illustrated).

The steering device 8 is an apparatus that is configured to steer the travelling wheels 7 by using a reaction force from the guide rails 3 when the guide-rail track vehicle 1 travels on the track 2. As illustrated in FIG. 1, the steering device 8 includes steering arms 17; steering rods 18; and a guiding frame 19.

The steering arm 17 is a member for allowing the travelling wheel 7 to swing about the kingpin 16. The steering arm 17 can swing along with the travelling wheel 7, and for example, is formed in such a manner as to extend in a travel direction.

The steering rod 18 is a member for allowing the transmission of force from the guiding frame 19 to the steering arm 17. A lateral inner end portion of the steering rod 18 is connected to a lateral center portion of the guiding frame 19. A lateral outer end portion of the steering rod 18 is connected to an end portion of the steering arm 17. For example, the steering rod 18 is pin-coupled to the guiding frame 19 and the steering arm 17 in such a manner so as to be able to turn about an axial line extending in a vertical direction.

The guiding frame 19 is a member configured to receive a reaction force from the guide rail 3, and to turn along the arced shape of a curved portion of the track 2. The guiding frame 19 includes a pair of cross beams 20; a pair of longitudinal beams 21; and a plurality of guide wheels 22.

One of the pair of cross beams 20 is disposed in front of the travelling wheels 7, and the other is disposed behind the travelling wheels 7, and the pair of cross beams 20 extends in the vehicle lateral direction. The cross beam 20 is formed in such a manner that the length of the cross beam 20 is slightly shorter than the distance between the guide rails 3 in the vehicle lateral direction. Each end portion of the cross beam 20 has a guide wheel support portion 23.

The pair of longitudinal beams 21 extends in the travel direction, and the pair of cross beams 20 is joined together in the travel direction via the pair of longitudinal beams 21. The respective lateral center portions of the cross beams 20 are connected to each other via the longitudinal beams 21. A bearing support portion (refer to FIG. 1) configured to support a bearing is formed in a longitudinal center portion of each of the pair of longitudinal beams 21. The longitudinal beams 21 are attached to bogie frames 26 (to be described later) via the bearing 25 supported by the bearing support portions 24 in such a manner so as to be able to turn about an axial line extending in the vertical direction. The vertical direction referred to here is a direction perpendicular to the travel path 4 of the track 2.

The guiding frame 19 includes a guiding frame coupling portion 27 to which the lateral inner end portion of the steering rod 18 is connected. The guiding frame coupling portion 27 is disposed between the pair of longitudinal beams 21, and is suspended between the cross beam 20 and the bearing support portion 24. In FIG. 1, reference sign "28" denotes a reinforcement member provided between the longitudinal beam 21 and the cross beam 20.

The guide wheel 22 is a member which is in contact with the guide rail 3 and through which a reaction force applied inward in the vehicle lateral direction by the guide rail 3 is transmitted to the cross beam 20. The guide wheel 22 is attached to the guide wheel support portion 23 of the cross beam 20 in such a manner so as to be able to rotate about an axial line extending in the vertical direction. The guide wheels 22 in contact with the guide rails 3 rotate when the guide-rail track vehicle 1 travels.

When the guide-rail track vehicle 1 travels on the curved portion of the track 2, in the steering device 8, the cross beams 20 of the guiding frame 19 receive a reaction force from the guide rails 3, and the guiding frame 19 turns along the arc of the curved portion of the guiding frame 19. Accordingly, the steering rods 18 attached to the guiding frame 19 push and pull the end portions of the steering arms 17 in the same direction as a turn direction of the guiding frame 19. As a result, each of the steering arms 17 swings, and the travelling wheel 7 swings about the kingpin 16 along with the steering arm 17.

The suspension apparatus 9 is an apparatus that is configured to transmit a drive force or a braking force (hereinafter, simply referred to as "force in the travel direction") of the travelling wheel 7 to the car body 5 while allowing a vertical displacement of the travelling wheel 7 relative to the car body 5. The suspension apparatus 9 includes a pair of the bogie frames 26; a pair of suspension frame 29; and a parallel link device 30.

The pair of bogie frames 26 are members that are configured to transmit force in the travel direction to the parallel link device 30, and to support the respective bottoms of air springs 31 (to be described later) of the dampening apparatus 10. The bogie frames 26 are disposed while being separate from each other in the vehicle lateral direction, and are formed in such a manner that the axle 14 and an axle cover (not illustrated) are interposed therebetween in the vertical direction.

The force in the travel direction transmitted to the pair of suspension frames 29 via the parallel link device is transmitted to the car body 5 via the pair of suspension frames 29. As illustrated in FIG. 2, the suspension frame 29 is configured to include a car body attachment/fixation portion 32 and a parallel link receiving portion 33. The car body attachment/fixation portion 32 is fixed to a car body underframe 35 using tightening members (not illustrated) such as bolts, and the car body underframe 35 is formed in such a manner so as to extend along a vehicle floor surface 34 of the car body 5 in a longitudinal direction of the car body.

The parallel link receiving portion 33 is formed in such a manner so as to extend vertically downward from an inner end portion of the car body attachment/fixation portion 32 in the longitudinal direction of the car body. The parallel link receiving portion 33 is disposed inside each of the pair of bogie frames 26 in the longitudinal direction of the car body. The parallel link receiving portions 33 are separate from each other in the vehicle lateral direction, similar to the bogie frame 26, and the parallel link receiving portion 33 is disposed in such a manner so as to overlap the bogie frame 26 when seen in the travel direction. Here, the pair of bogie frames 26 are coupled together via bogie frames 39 (refer to FIG. 1), each of which is configured to extend in the vehicle lateral direction.

The parallel link device 30 transmits force in the travel direction from the bogie frame 26 to the suspension frame 29 while allowing the bogie frame 26 to be vertically displaced relative to the suspension frame 29. The parallel link device 30 connects the bogie frame 26 to the suspension frame 29 while allowing the suspension frame 29 to be tiltable relative to the bogie frame 26 in the vehicle lateral direction. The parallel link device 30 includes pairs of upper and lower parallel links 36, each of which is disposed while being separate from each other in the vehicle lateral direction.

The parallel link 36 includes a pair of upper link member 37 and lower link member 38. The upper link member 37 and the lower link member 38 are attached to the bogie frame 26 and the suspension frame 29 while being in parallel to each other and being suspended between the bogie frame 26 and the suspension frame 29. More specifically, the upper link member 37 is configured to connect the bogie frame 26 to the suspension frame 29, both of which are positioned above the axle 14, and the lower link member 38 is configured to connect the bogie frame 26 to the suspension frame 29, both of which are positioned below the axle 14. End portions of each of the upper link member 37 and the lower link member 38 are coupled respectively to the bogie frame 26 and the suspension frame 29 in such a manner that the upper link member 37 and the lower link member 38 can swing relative to the bogie frame 26 and the suspension frame 29 in the vertical direction, and the upper link member 37 and the lower link member 38 can swing laterally relative to one of the bogie frame 26 and the suspension frame 29.

The dampening apparatus 10 prevents vertical vibration of the bogie 6 from being transmitted mainly to the car body 5. The dampening apparatus 10 in the embodiment is configured as the air spring 31. At least a pair of the air springs 31 is provided in one of the bogies 6, and is disposed while being separate from each other in the vehicle lateral direction. The air spring 31 is made of an elastic material such as rubber, inside which compressed air can be stored. The air spring 31 is disposed while being interposed between the bogie frame 26 and the car body 5. A height adjustment apparatus 40 is connected to each of the air springs 31.

The height adjustment apparatus 40 is an apparatus that is configured to supply and discharge compressed air to and from the air spring 31. The height adjustment apparatus 40 includes a leveling valve 41; an air reservoir (not illustrated), and a pipe (not illustrated) for suctioning compressed air. The air reservoir referred to here stores air that is compressed to a predetermined pressure by a compressor (not illustrated) or the like. The pipe forms a flow path between the air reservoir and the air spring 31. For illustrative purposes, FIG. 1 does not illustrate the leveling valve 41 and an adjustment support bar 42 (to be described later).

The leveling valve 41 is a control valve which is configured to adjust the internal pressure of the air spring 31 in such a manner that the height of the air spring 31 is in a predetermined range of height. The height of the air spring 31 referred to here changes with a change in the weight of the car body 5, for example, a change in the number of passengers in the guide-rail track vehicle 1. For this reason, a main object of the leveling valve 41 is not to allow the car body 5 to be tilted by setting the respective heights of the air springs 31 to be equal, the air springs 31 being disposed respectively on the opposite lateral sides.

The leveling valve 41 opens and closes an air supply path between the air spring 31 and the air reservoir, and an air discharge path between the air spring 31 and the outside. The leveling valve 41 is provided in each of the air springs 31. The leveling valve 41 is supported by the car body 5 via the adjustment valve support bar (height adjustment apparatus moving mechanism) 42 that has a bar shape and extends in the vehicle lateral direction. The adjustment valve support bar 42 is formed in such a manner that the length of the adjustment valve support bar 42 is much longer than the gap between the air springs 31 separate from each other in the vehicle lateral direction. A lateral center portion of the adjustment valve support bar 42 is turnably supported by a bracket 43 (refer to FIG. 3) extending downward from the vehicle floor surface 34.

The leveling valve 41 includes a lever 44 (illustrated by a dotted line in FIG. 3) for opening and closing the air supply path and the air discharge path. For example, the lever 44 extends in the vehicle lateral direction. An end portion of the lever 44 is connected to the air spring 31 via an adjustment rod (automatic height adjustment mechanism) 45 in such a manner that a relationship in a vertical position between the lever 44 and the bogie frame 26, the axle cover, or the like disposed below the air spring is constantly maintained. Here, when the height of one of the air springs 31 is changed based on the assumption that a relative position between the air spring 31 and the leveling valve 41 corresponding to the air spring 31 is not changed, the lever 44 is operated to swing by the adjustment rod 45.

More specifically, when the length of the air spring 31 is shorter than a predetermined length, the leveling valve 41 is displaced vertically so as to approach the bogie frame 26 or the like which is a member below a spring. Accordingly, the adjustment rod 45 pushes the end portion of the lever 44 relatively upward, the air supply path is opened by the leveling valve 41, and compressed air is supplied to the air spring 31. In contrast, when the length of the air spring 31 is longer than the predetermined length, the leveling valve 41 is displaced vertically so as to separate from the bogie frame 26 or the like which is a member below a spring. Accordingly, the adjustment rod 45 pulls the end portion of the lever 44 relatively downward, the air discharge path is opened by the leveling valve 41, and compressed air is discharged out of the air spring 31. That is, the automatic height adjustment mechanism of the present invention is made up of the leveling valve 41 and the adjustment rod 45. The leveling valve 41 is configured so as to open the air supply path and close the air discharge path, or to open the air discharge path and close the air supply path.

The detection unit 12 detects the degree of turning of the guiding frame 19. The detection unit 12 includes a displacement sensor 46 and a link portion (link mechanism) 47, and is provided in each of the suspension frames 29 which are disposed while being separate from each other in the vehicle lateral direction.

The link portion 47 converts a displacement of the guiding frame 19 in the turn direction into a linear displacement, more specifically, a vertical displacement, and transmits the converted displacement to the displacement sensor 46.

As illustrated in FIG. 3, the link portion 47 includes a horizontal rod 48; a horizontal detection link 49; and a vertical rod 50.

The horizontal rod 48 is disposed so as to extend in the vehicle lateral direction in a region above the cross beam 20 of the guiding frame 19 when the guide-rail track vehicle 1 travels on a linear portion of the track 2 (hereinafter, simply referred to as linear travel). A lateral outer end portion of the horizontal rod 48 is coupled to the cross beam 20 of the guiding frame 19. Accordingly, the horizontal rod 48 is configured to be able to swing relative to the cross beam 20. A lateral inner end portion of the horizontal rod 48 is coupled to a lower end portion of the horizontal detection link 49. That is, the horizontal rod 48 is also configured to be able to swing relative to the horizontal detection link 49.

The horizontal detection link 49 is supported by the suspension frame 29 in such a manner so as to be able to turn about an axial line extending in the longitudinal direction of the car body. The horizontal detection link 49 includes a first arm portion 51 configured to extend downward from a turning center during linear travel, and a second arm portion 52 configured to extend outward in the vehicle lateral direction from the turning center during linear travel. That is, the first arm portion 51 and the second arm portion 52 of the horizontal detection link 49 form an L shape, and the horizontal detection link 49 converts a displacement of an end portion of the first arm portion 51 in the vehicle lateral direction into a vertical displacement of an end portion of the second arm portion 52. The lateral inner end portion of the horizontal rod 48 is swingably coupled to a lower end portion of the first arm portion 51.

The vertical rod 50 transmits a vertical displacement of an end portion of the second arm portion 52 to the displacement sensor 46. The vertical rod 50 is formed in the shape of a bar extending in the vertical direction. A lower end portion of the vertical rod 50 is swingably coupled to an end portion of the second arm portion 52, and an upper end portion of the vertical rod 50 is connected to the displacement sensor 46. Here, the horizontal detection link 49 and the vertical rod 50 are preferably coupled together in such a manner so as to be able to swing relative to each other in the vehicle lateral direction, and for example, the horizontal detection link 49 and the vertical rod 50 can be coupled together via a pin extending in the longitudinal direction of the car body, or via a universal joint. The horizontal rod 48 is coupled to the horizontal detection link 49 using a universal joint such as a ball joint so as to allow the guiding frame 19 to be displaced relative to the horizontal detection link 49 in the longitudinal direction of the car body.

The displacement sensor 46 is a sensor configured to detect the amount of vertical displacement of the vertical rod 50. For example, the displacement sensor 46 is fixed to the vehicle floor surface 34 of the car body 5, the suspension frame 29 attached to the car body 5, or the like, and thereby the displacement sensor 46 is not displaced vertically relative to the car body 5.

The amount of vertical displacement of the vertical rod 50 referred to here changes with the degree of turning of the guiding frame 19, and for example, increases to the extent that the curvature of the track 2 is increased. In other words, the degree of turning of the guiding frame 19 increases to the extent that the curvature radius of the track 2 is decreased. That is, it is possible to obtain the degree of turning of the guiding frame 19 based on a pre-set relationship between the degree of turning and the curvature, and the amount of displacement obtained by the displacement sensor 46. Information regarding a detection result from the displacement sensor 46 is input to the tilt control unit 13.

The car body tilting mechanism 11 is an apparatus that is configured to tilt the car body 5 relative to the bogie 6 in the vehicle lateral direction. The car body tilting mechanism 11 includes a tilt drive unit 53 and the adjustment valve support bar 42.

The tilt drive unit 53 generates power to tilt the car body 5 based on the detection result from the detection unit 12. For example, the tilt drive unit 53 includes an expandable and contractible actuator 54 as a power source.

The actuator 54 is attached to the bogie frame 26 and the adjustment valve support bar 42 while being suspended therebetween, and is disposed outside a turning center of the adjustment valve support bar 42 in the vehicle lateral direction. The actuator 54 can tilt the adjustment valve support bar 42 by displacing a vertical gap between attachment positions of the actuator 54 relative to the bogie frame 26 and the adjustment valve support bar 42.

The actuator 54 expands and contracts between a linear position and a leftward tilting position, or between the linear position and a rightward tilting position. When the actuator 54 takes the linear position, the adjustment valve support bar 42 is held in a state where the adjustment valve support bar 42 extends in the vehicle lateral direction. When the actuator 54 takes the leftward tilting position, the adjustment valve support bar 42 is tilted leftward of the linear position in the vehicle lateral direction. When the actuator 54 takes the rightward tilting position, the adjustment valve support bar 42 is tilted rightward of the linear position in the vehicle lateral direction.

It is possible to use various linear motion mechanisms as the actuator 54. The linear motion mechanism can be configured as a cylinder using working fluid, a ball screw operated by the driving of a motor, a rack and pinion, and the like.

The tilt control unit 13 controls the driving of the tilt drive unit 53 of the car body tilting mechanism 11 based on the detection result from the detection unit 12.

Figure 4:
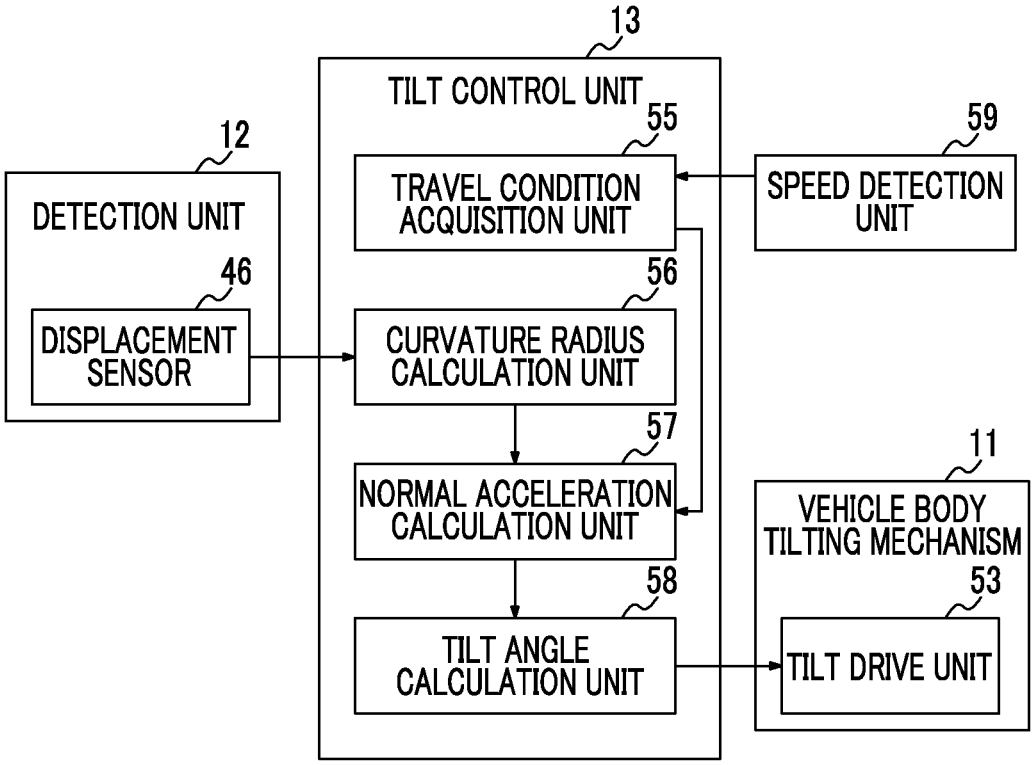
FIG. 4 is a block diagram illustrating a configuration of a tilt control unit in the embodiment.

As illustrated in FIG. 4, the tilt control unit 13 includes a running condition acquisition unit 55; a curvature radius calculation unit 56; a normal acceleration calculation unit 57; and a tilt angle calculation unit 58.

The running condition acquisition unit 55 acquires vehicle speed information as a running condition from a speed detection unit 59 such as a speed generator.

Figure 5:
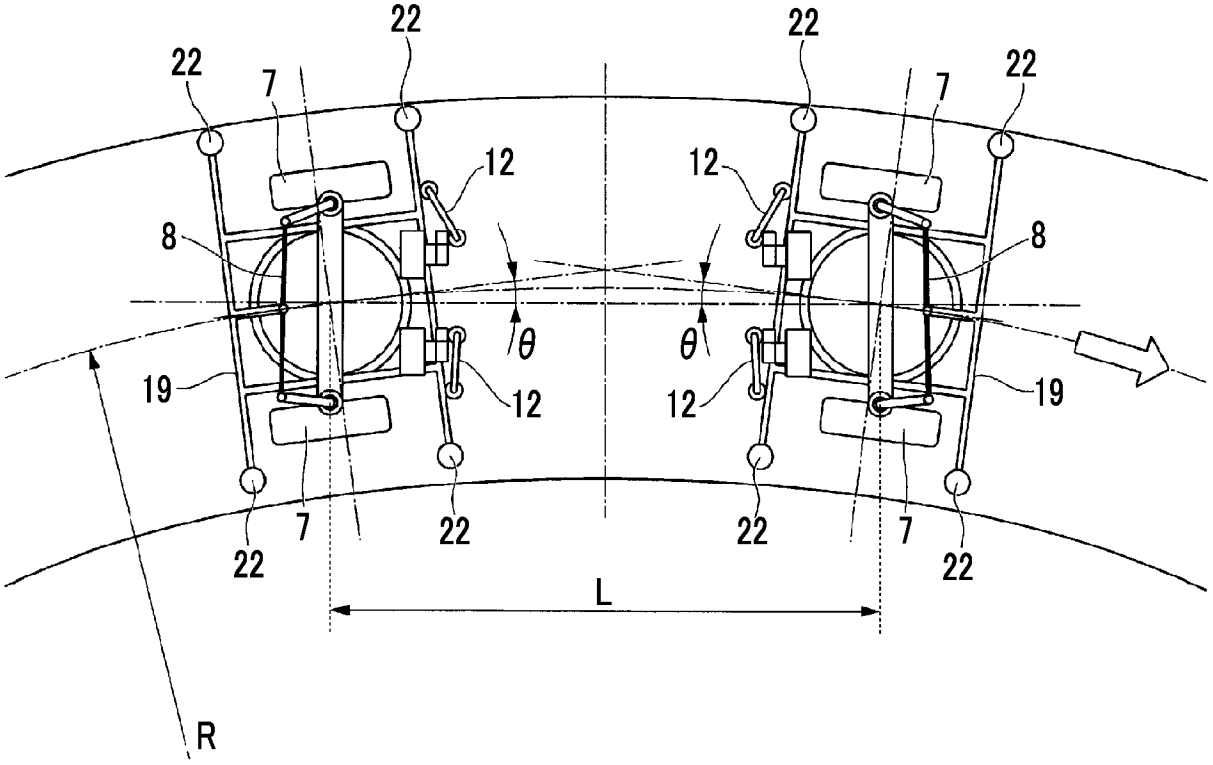
FIG. 5 is a plan view illustrating before and after states of the bogie when travels on a curved portion in the embodiment.

The curvature radius calculation unit 56 calculates the curvature radius of the track 2 from the degree of turning of the guiding frame 19, which is detected by the detection unit 12. As illustrated in FIG. 5, if a wheelbase of the guide-rail track vehicle 1 and the curvature radius are supposed to be "L" (m) and "R" (m), respectively, the degree "θ" (deg) of turning of the guiding frame can be represented by Expression (1).

$$\theta=\mathrm{Sin}^{-1}(L/2)/R) \tag{1}$$

The wheelbase "L" referred to here is pre-determined for each of the guide-rail track vehicles 1, and in the embodiment, the wheelbase "L" is the distance between a turning center of the guiding frame 19 of the front bogie 6 and a turning center of the guiding frame 19 of the rear bogie 6.

Accordingly, the curvature radius "R" can be obtained using Expression (2) written below.

$$R=(L/2)/\mathrm{Sin}\ \theta \tag{2}$$

The normal acceleration calculation unit 57 calculates normal lateral acceleration applied to passengers in the vehicle based on the vehicle speed and the curvature radius. Here, if the vehicle speed of the guide-rail track vehicle 1 when rounding a curve is supposed to be "V" (km/h), it is possible to obtain unbalanced centrifugal acceleration "αs" (G) using Expression (3) written below.

$$\alpha s=(V^2)/(127R) \tag{3}$$

If a tilt angle of the car body 5, which is tilted toward an outer rail by a spring system of the dampening apparatus 10 of the guide-rail track vehicle 1 due to the unbalanced centrifugal acceleration when the vehicle rounds the curve, is "k" (rad), normal lateral acceleration "αp" (G) applied to the passengers when the vehicle rounds the curve can be obtained using Expression (4) written below. The normal lateral acceleration obtained using Expression (4) is normal lateral acceleration applied to the passengers when the car body 5 is not tilted toward an inner rail by the car body tilting mechanism 11.

$$\alpha p=\alpha s+k \quad (4)$$

The tilt angle calculation unit 58 calculates the lateral tilt angle of the car body 5 based on the normal lateral acceleration. In other words, the tilt angle calculation unit 58 calculates a tilt angle of the car body 5 required to counteract the normal lateral acceleration applied to the passengers. The tilt control unit 13 controls the driving of the tilt drive unit 53 based on the tilt angle calculated by the tilt angle calculation unit 58.

Typically, the normal lateral acceleration to cause the passengers to become uncomfortable is 0.08 (G) or greater. An ideal value of the normal lateral acceleration is "0"; however, a target value of the normal lateral acceleration is set to be in a range of 0.00 (G) to 0.02 (G) when an error or the like in the calculation result is taken into consideration. An optimal tilt angle "ξ" (rad) of the car body 5 tilted toward the inner rail when the vehicle rounds a curve can be represented by Expression (5) written below.

$$\xi-\alpha p=0.0\text{-}0.02$$

$$\xi=\alpha p+(0.0\text{-}0.02) \quad (5)$$

A description given hereinafter relates to an operation of the car body tilting mechanism 11 when the guide-rail track vehicle 1 travels on a curved portion of the track 2.

First, when the guide-rail track vehicle 1 enters the curved portion, the tilt control unit 13 performs a tilt control step of obtaining a tilt angle of the car body 5 based on detection results from a pair of the displacement sensors 46.

Figure 6:
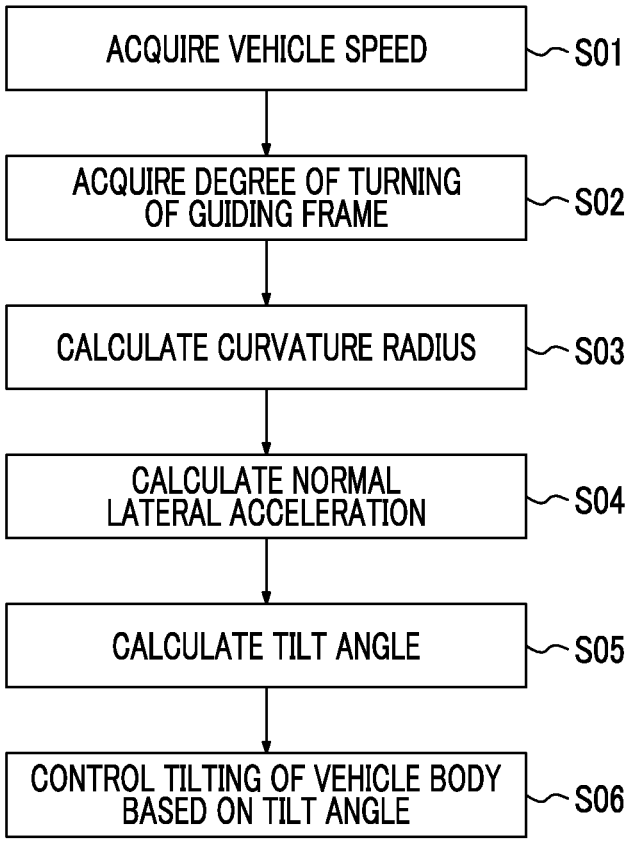
FIG. 6 is a flowchart illustrating an operation of the tilt control unit in the embodiment.

More specifically, first, the speed detection unit 59 detects a vehicle speed, and the displacement sensor 46 detects the degree of turning of the guiding frame 19 (detection step). Subsequently, as illustrated in FIG. 6, the tilt control unit 13 acquires the vehicle speed detected by the speed detection unit 59 from the running condition acquisition unit 55 (step S01: running condition acquisition step). In parallel with the running condition acquisition step, the tilt control unit 13 acquires the degree of turning of the guiding frame 19 detected by the displacement sensor 46 from the curvature radius calculation unit 56 (step S02).

Subsequently, the tilt control unit 13 calculates the curvature radius of the track 2 from the degree of turning of the guiding frame 19 using the curvature radius calculation unit 56 (step S03: curvature radius calculation step).

The tilt control unit 13 obtains normal lateral acceleration applied to passengers in the vehicle calculated by the normal acceleration calculation unit 57 based on information regarding the vehicle speed and the curvature radius (step S04: normal acceleration calculation step).

Subsequently, the tilt control unit 13 obtains the lateral tilt angle of the car body 5 calculated by the tilt angle calculation unit 58 based on the normal lateral acceleration obtained by the normal acceleration calculation unit 57 (step S05: tilt angle calculation step).

The tilt control unit 13 controls the driving of the tilt drive unit 53 such that the tilt angle is equal to the calculated tilt angle (step S06).

The tilt control unit 13 tilts the adjustment valve support bar 42 toward a curved inner rail by displacing the actuator 54 of the tilt drive unit 53 from the linear position to the leftward tilting position or the rightward tilting position. At this time, the tilt control unit 13 controls the driving of the actuator 54 of the tilt drive unit 53 such that the adjustment valve support bar 42 is tilted at the tilt angle calculated by the tilt angle calculation unit 58. Accordingly, the vertical gap between the opposite end portions of the adjustment valve support bar 42 and a member below a spring such as the bogie frame 26 is changed. For this reason, the lever 44 of the leveling valve 41 is operated corresponding to the degree and the orientation of tilting of the adjustment valve support bar 42 by the adjustment rod 45. One of the leveling valves 41 positioned close to one of the opposite end portions of the adjustment valve support bar 42 is operated to supply air, the one being disposed relatively above the other end portion, and the other leveling valve 41, which is positioned close to the other end portion disposed relatively below the one end portion, is operated to discharge air. As a result, this operation causes a difference in height between the air springs 31 which are disposed while being separate from each other in the vehicle lateral direction, the car body 5 is tilted toward the inner rail to the extent of the difference in height.

Accordingly, in the guide-rail track vehicle 1 of the first embodiment, when the guiding frame 19 turns due to a reaction force from the guide rail 3, it is possible to detect the degree of turning using the detection unit 12. In addition, it is possible to tilt the car body 5 in the vehicle lateral direction by allowing the tilt control unit 13 to control the driving of the actuator 54 based on the degree of turning of the guiding frame 19. As a result, it is possible to more reliably prevent ride quality from deteriorating when the guide-rail track vehicle 1 travels on a curved portion of the track 2 without increasing rolling rigidity or excessively increasing the size of the bogie 6.

In order to turn the travelling wheels 7, the degree of turning of the guiding frame 19 detected by the detection unit 12 can be converted into a vertical displacement of the vertical rod 50, and the converted vertical displacement can be detected by the displacement sensor 46. As a result, with a simple configuration, it is possible to detect the entry of the guide-rail track vehicle 1 into the curve portion while preventing an increase in the number of components.

The tilt control unit 13 controls the driving of the actuator 54 of the tilt drive unit 53 such that the tilt angle of the adjustment valve support bar 42 is changed, and thereby, it is possible to change the height position of the leveling valve 41 of each of the air springs 31 which are disposed while being separate from each other in the vehicle lateral direction. For this reason, it is possible to set the respective lengths of the air springs to be different from each other by effectively utilizing the height adjustment mechanism of each of the air springs 31 for maintaining the height of the car body 5 to be constant, the air springs 31 being disposed while being separate from each other in the vehicle lateral direction. As a result, it is possible to easily tilt the car body 5 by controlling the driving of only one of the actuators 54.

Subsequently, a guide-rail track vehicle in a second embodiment of the present invention will be described. Since the configuration of a car body tilting mechanism is the only difference between the guide-rail track vehicle in the second embodiment and the guide-rail track vehicle in the first embodiment, a description will be given with the same reference signs assigned to the same parts.

Figure 7:
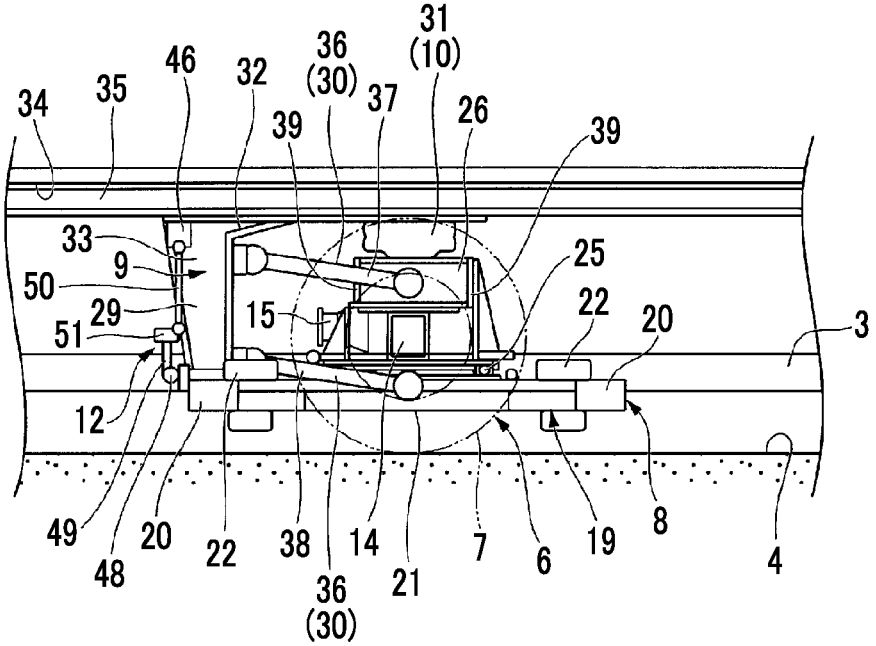
FIG. 7 is a side view in a second embodiment of the present invention, which is equivalent to FIG. 2.
Figure 8:
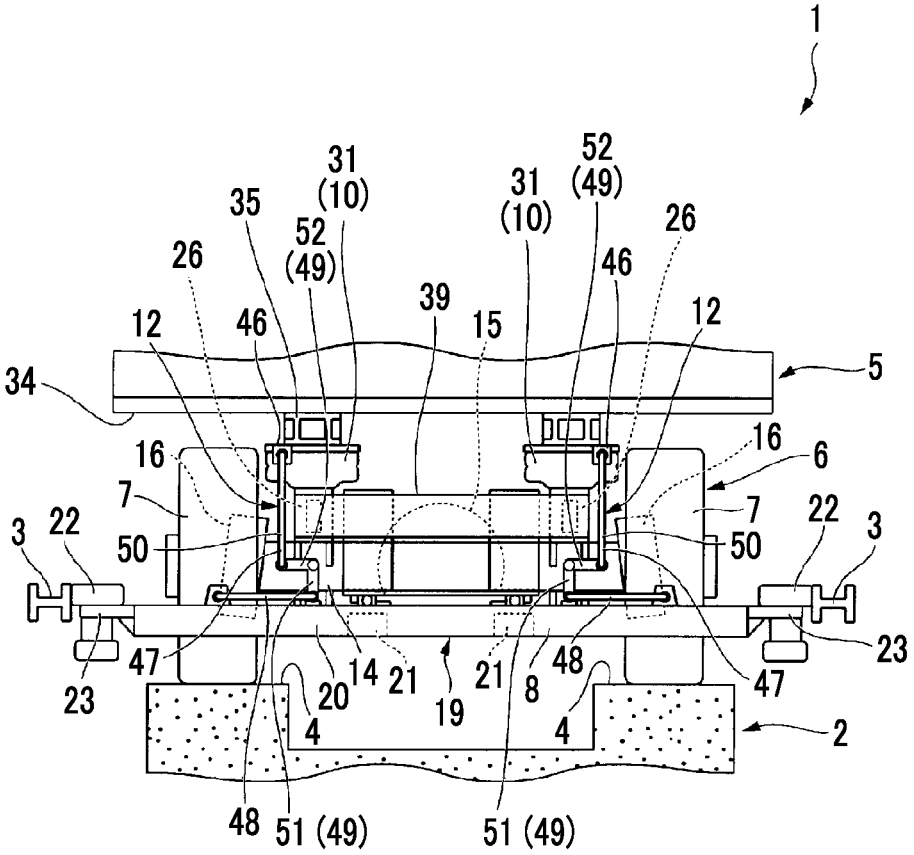
FIG. 8 is a front view in the embodiment, which is equivalent to FIG. 3.

As illustrated in FIGS. 7 and 8, the guide-rail track vehicle in the second embodiment includes the car body 5 and the bogie 6. The bogie 6 includes the travelling wheels 7; the steering device 8; the suspension apparatus 9; the dampening apparatus 10; a car body tilting mechanism 211; a detection unit 12; and a tilt control unit 213. Since each of the travelling wheel 7, the steering device 8, the suspension apparatus 9, the dampening apparatus 10, the detection unit 12, and the tilt control unit 213 has the same configuration as that in the first embodiment, a detailed description thereof will be omitted. For illustrative purposes, FIGS. 7 and 8 do not illustrate the leveling valve 41 and the adjustment rod 45 which are configured to automatically adjust the height of the car body 5.

Similar to the first embodiment, the detection unit includes the displacement sensor 46 and the link portion 47, and detects the degree of turning of the guiding frame 19 after the degree of turning is converted into the amount of linear displacement of the vertical rod 50. The detection unit 12 is provided in each of the suspension frames 29 which are disposed while being separate from each other in the vehicle lateral direction. A detection result from the displacement sensor 46 is input to the tilt control unit 213.

Figure 9:
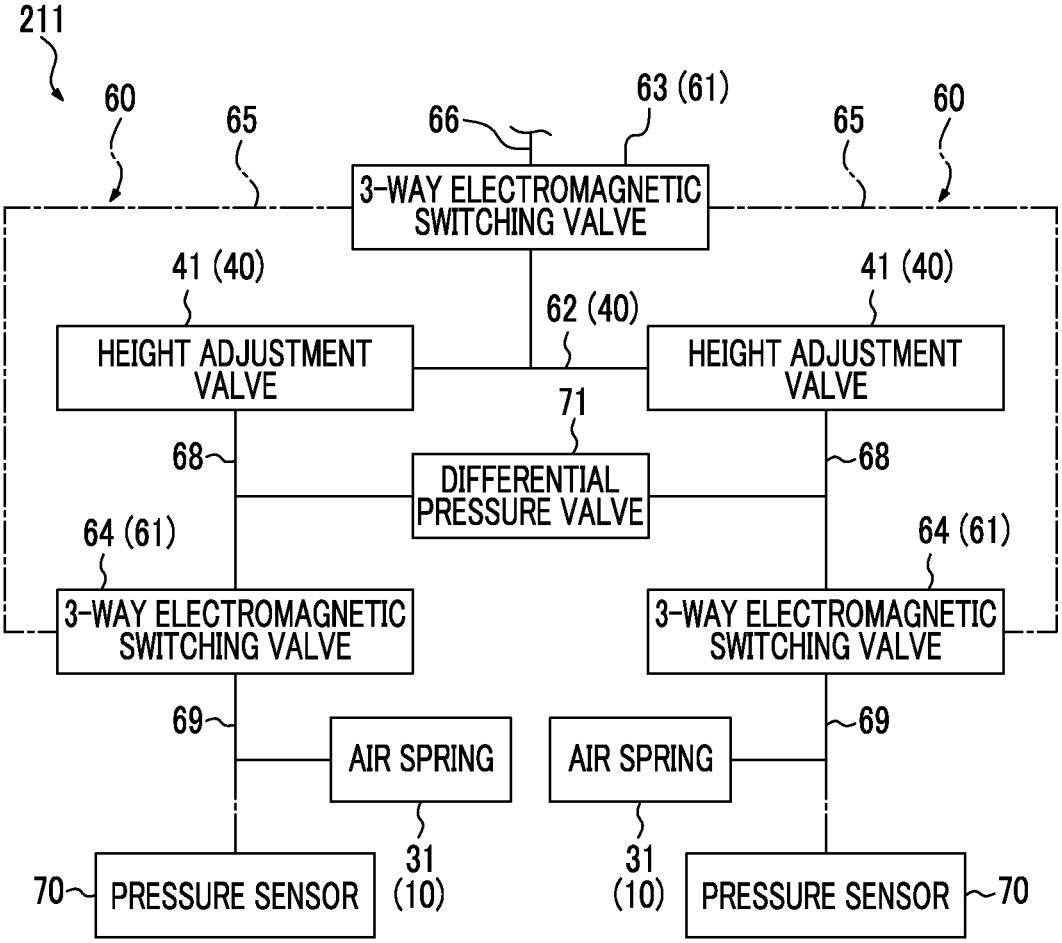
FIG. 9 is a hydraulic pressure circuit diagram illustrating a configuration of a car body tilting mechanism in the embodiment.

As illustrated in FIG. 9, the dampening apparatus 10 in the second embodiment is configured as the air spring 31 similar to the first embodiment. The height adjustment apparatus 40 is connected to the air spring 31. The height adjustment apparatus 40 includes the leveling valve 41; the air reservoir (not illustrated), and a pipe 62 for suctioning compressed air.

The car body tilting mechanism 211 tilts the car body 5 relative to the bogie 6 in the vehicle lateral direction. The car body tilting mechanism 211 includes a tilt angle controlling apparatus 60 and a tilt adjustment apparatus 61. The tilt angle controlling apparatus 60 adjusts the height of the air spring 31 while bypassing the leveling valve 41 operated by the adjustment rod 45. The tilt adjustment apparatus 61 restricts (prevents) the leveling valve 41 from adjusting the height of the air spring 31 when the tilt angle controlling apparatus 60 adjusts the height of the air spring 31.

The tilt angle controlling apparatus 60 includes a first 3-way electromagnetic switching valve 63; a bypass pipe 65; and a second 3-way electromagnetic switching valve 64. The first 3-way electromagnetic switching valve 63 and the second 3-way electromagnetic switching valve 64 are control valves configured to perform an opening and closing operation based on a control command from the tilt control unit 213. The tilt adjustment apparatus 61 is made up of the first 3-way electromagnetic switching valve 63 and the second 3-way electromagnetic switching valve 64.

The first 3-way electromagnetic switching valve 63 can switch pipe communication between a state in which a pipe 66 communicating with the air reservoir communicates with a pipe 62 connected to the leveling valve 41, and a state in which the pipe 66 communicates with the bypass pipe 65.

The second 3-way electromagnetic switching valve 64 can switch pipe communication between a state in which a pipe 69 connected to the air spring 31 communicates with a pipe 68 connected to the leveling valve 41, and a state in which the pipe 69 communicates with the bypass pipe 65. The second 3-way electromagnetic switching valve 64 can discharge compressed air inside the air spring 31. A pressure sensor 70 is attached to each of the pipes 69, and detects an internal compressed air pressure of the air spring 31. A detection result from the pressure sensor 70 is transmitted to the tilt control unit 213.

A differential pressure valve 71 is attached to a pipe between two pipes 68. The differential pressure valve 71 allows the two pipes 68 to communicate with each other when an internal pressure difference between two air springs 31 separate from each other in the vehicle lateral direction exceeds a predetermined pressure difference. For example, when either one of the two air springs 31 is flat, the differential pressure valve 71 is operated to adjust internal pressure values of the two air springs 31 to approach each other. Accordingly, it is possible to prevent the wheels from coming off the guide-rail track vehicle at an occurrence of the flat air spring 31.

Figure 10:
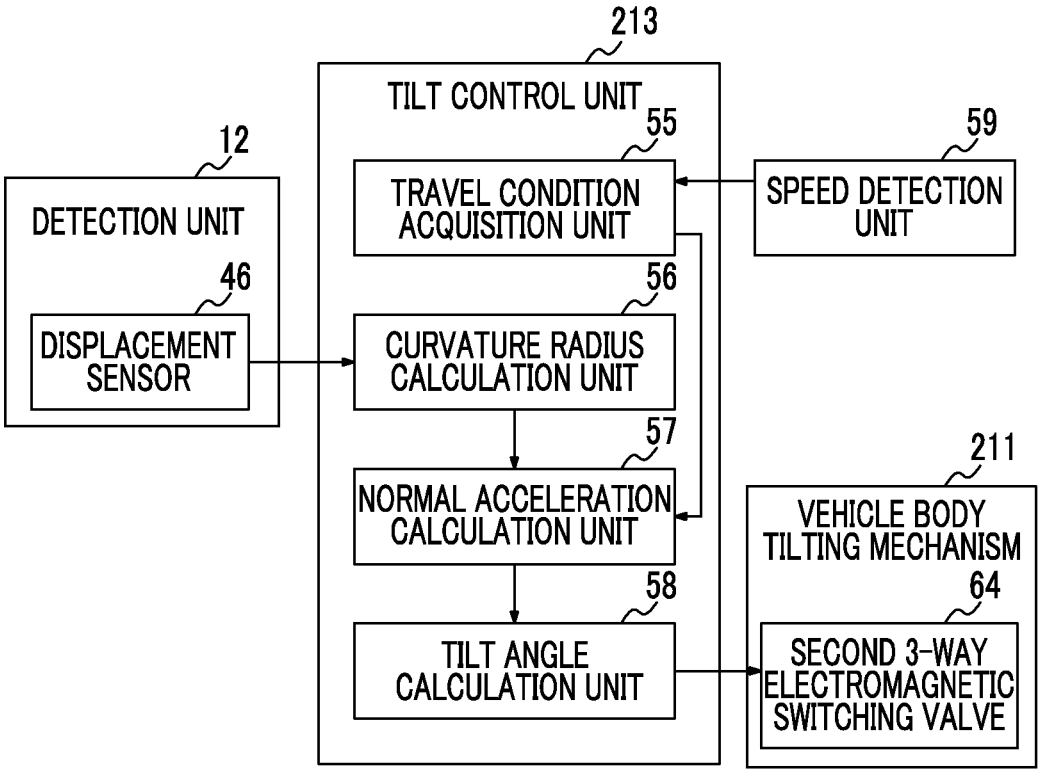
FIG. 10 is a block diagram in the embodiment, which is equivalent to FIG. 4.

As illustrated in FIG. 10, the tilt control unit 213 controls a tilt angle of the car body 5 via the car body tilting mechanism 211. More specifically, the tilt control unit 213 adjusts the height of the air spring 31 by controlling the driving of the tilt angle controlling apparatus 60 based on the detection result from the detection unit 12. At this time, the tilt control unit 213 deactivates an automatic height adjustment of the air spring 31 which is performed by the leveling valve 41, and adjusts the height of the air spring 31 using the tilt adjustment apparatus 61. A flow rate of compressed air which can flow through the tilt angle controlling apparatus 60 is set to be higher than that of compressed air which can flow through the leveling valve 41, and thereby, it is possible to enable rapid air intake and discharge.

Similar to the tilt control unit 13 in the first embodiment, the tilt control unit 213 includes the running condition acquisition unit 55; the curvature radius calculation unit 56; the normal acceleration calculation unit 57; and the tilt angle calculation unit 58. The car body tilting mechanism 211 obtains a target pressure value of each of the air springs 31 based on a calculation result from the tilt angle calculation unit 58, for example, based on expressions, tables, and maps. The tilt control unit 213 controls a flow rate of compressed air via the second 3-way electromagnetic switching valve 64 such that the pressure of the air spring 31 becomes a target pressure.

Accordingly, during a normal operation of the guide-rail track vehicle of the second embodiment, it is possible to automatically control the height of the air spring 31 using the leveling valve 41 and the adjustment rod 45 such that the car body 5 is not brought into a tilted state. In contrast, in order to tilt the car body 5, it is possible to individually adjust the height of each of the air springs 31 using the bypass pipe 65 and the second 3-way electromagnetic switching valve 64.

Since the height of each of the air springs 31 is adjusted by the bypass pipe 65 and the second 3-way electromagnetic switching valve 64 in a state where the leveling valve 41 is restricted from adjusting the height of the air spring 31, an operation of the leveling valve 41 can be prevented from disturbing the tilting of the car body 5. Accordingly, the respective heights of the air springs 31 are set to be different from each other, and thus the car body 5 is tilted. As a result, it is possible to more reliably prevent ride quality from deteriorating when the guide-rail track vehicle travels on a curved portion of the track 2.

In addition, in the guide-rail track vehicle of the second embodiment, a flow rate of compressed air supplied to the air spring 31 via the bypass pipe 65 and the second 3-way electromagnetic switching valve 64 (the tilt angle controlling apparatus 60) can be set to be higher than that of compressed air supplied to the air spring 31 via the pipe 62, the leveling valve 41 and the pipe 68. For this reason, the car body 5 can be rapidly tilted, and deterioration in ride quality associated with a delay in tilt timing can be prevented.

Subsequently, a guide-rail track vehicle in a third embodiment will be described. Since part of a car body tilting mechanism is the only difference between the respective guide-rail track vehicles of the second embodiment and the third embodiment, a description will be given with the same reference signs assigned to the same parts.

Figure 11:
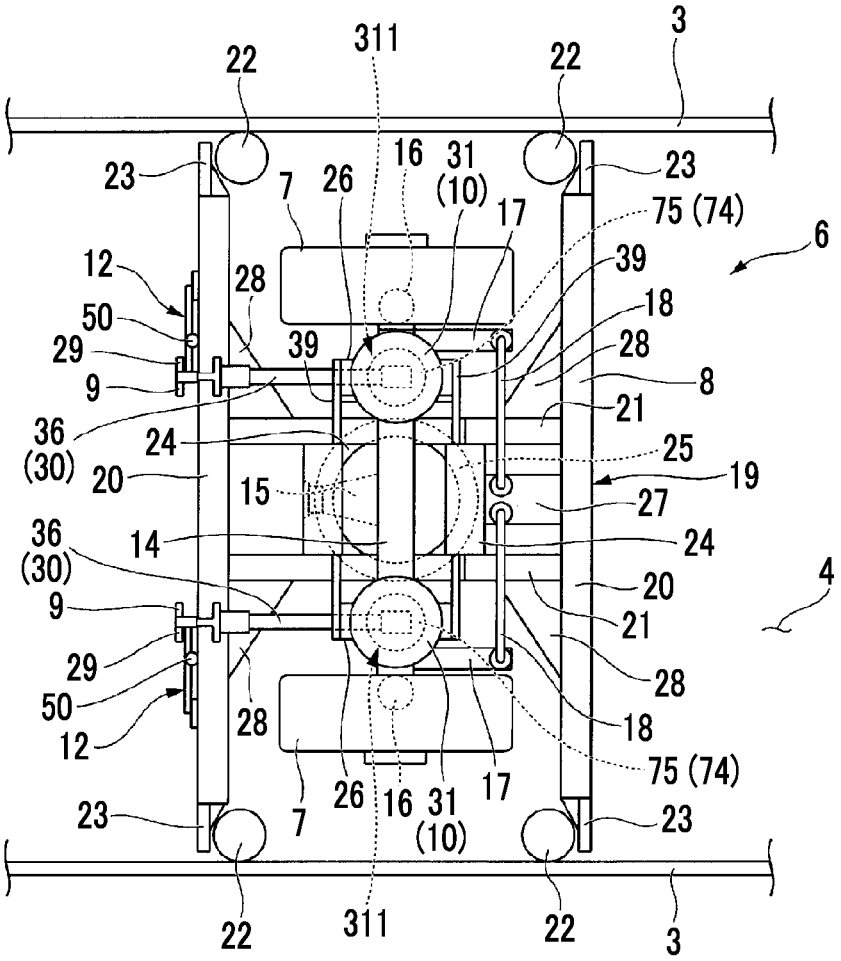
FIG. 11 is a side plan view in a third embodiment of the present invention, which is equivalent to FIG. 1.
Figure 12:
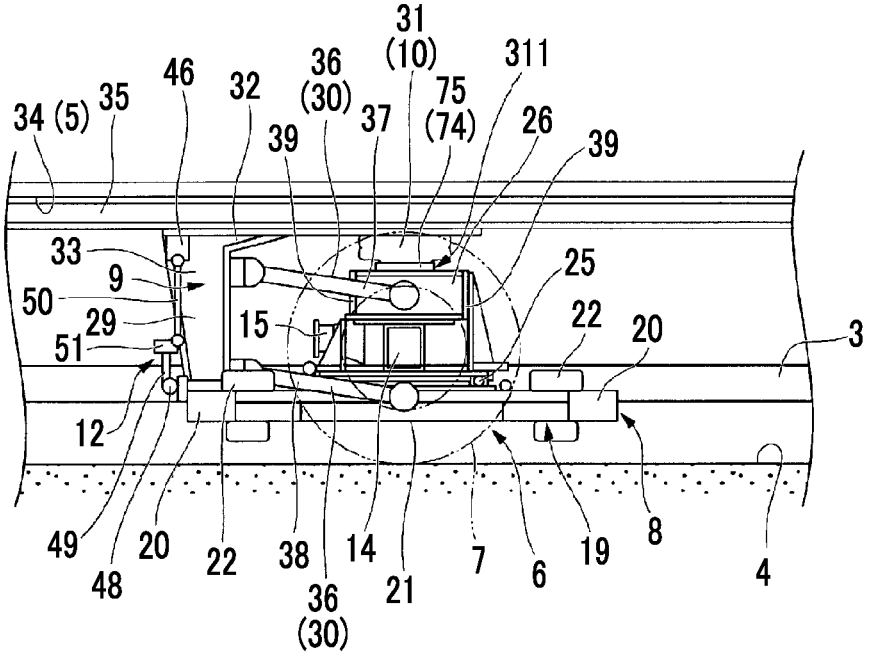
FIG. 12 is a side view in the embodiment, which is equivalent to FIG. 2.
Figure 13:
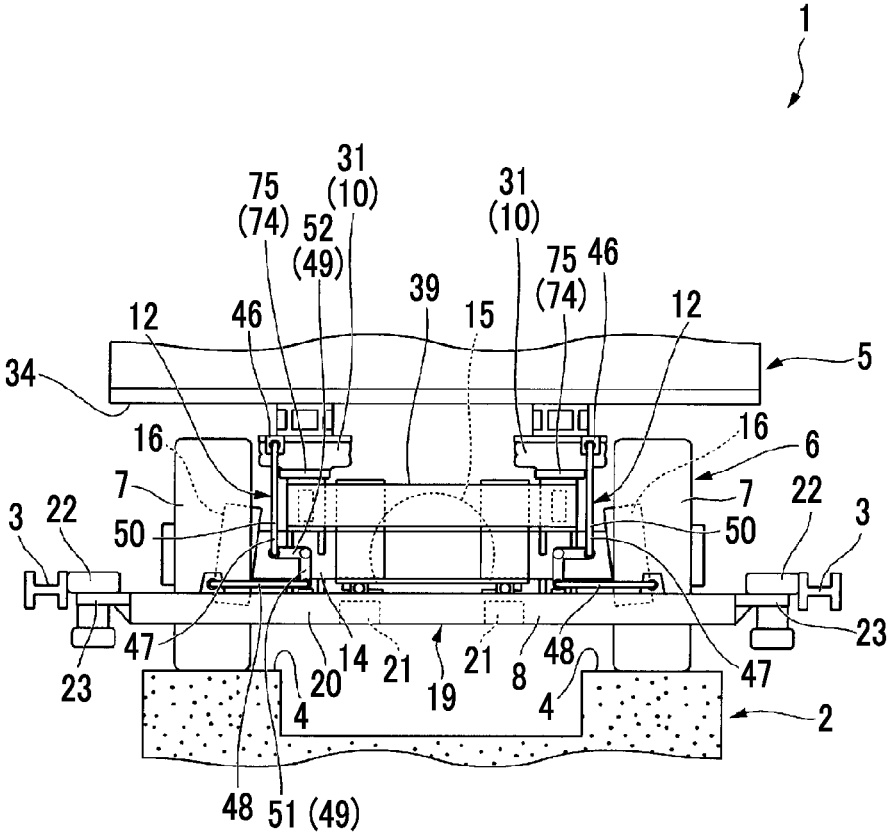
FIG. 13 is a front view in the embodiment, which is equivalent to FIG. 3.

As illustrated in FIGS. 11 to 13, the guide-rail track vehicle in the third embodiment includes the car body 5 and the bogie 6. The bogie 6 includes the travelling wheels 7; the steering device 8; the suspension apparatus 9; the dampening apparatus 10; a car body tilting mechanism 311; a detection unit 12; and a tilt control unit 313 (refer to FIG. 15). Since each of the travelling wheel 7, the steering device 8, the suspension apparatus 9, the dampening apparatus 10, the detection unit 12, and the tilt control unit 313 has the same configuration as that in the first embodiment, a detailed description thereof will be omitted. For illustrative purposes, FIGS. 11 to 13 do not illustrate the leveling valve 41 and the adjustment rod 45 which are configured to automatically adjust the height of the car body 5.

Similar to the first embodiment, the detection unit includes the displacement sensor 46 and the link portion 47, and detects the degree of turning of the guiding frame 19 after the degree of turning is converted into the amount of linear displacement of the vertical rod 50. The detection unit 12 is provided in each of the suspension frames 29 which are disposed while being separate from each other in the vehicle lateral direction. A detection result from the displacement sensor 46 is input to the tilt control unit 313.

Figure 14:
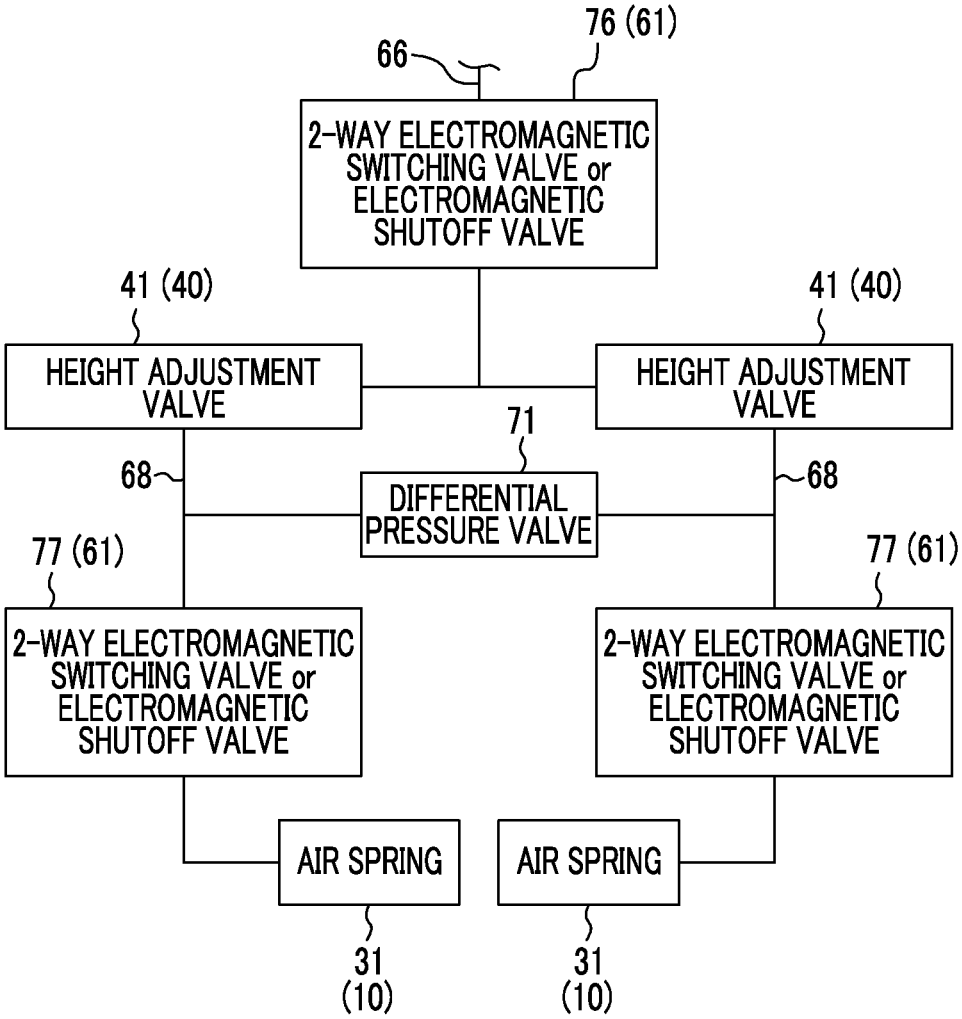
FIG. 14 is a block diagram in the embodiment, which is equivalent to FIG. 9.

The car body tilting mechanism 311 includes a car body lifting up and down apparatus 74 and the tilt adjustment apparatus 61 (refer to FIG. 14).

The car body lifting up and down apparatus 74 supports the bottom of the air spring 31 of the dampening apparatus 10 in such a manner that the air spring 31 can move in the vertical direction. The car body lifting up and down apparatus 74 includes an actuator 75. The actuator 75 includes a linear motion mechanism that is expandable and contractable in the vertical direction. The actuator 75 is interposed between an upper surface of the bogie frame 26 and a lower surface of the air spring 31, and can change the distance between the bogie frame 26 and the air spring 31. For example, the actuator 75 can be configured as a cylinder or the like that is driven by a fluid pressure or the like.

As illustrated in FIG. 14, the tilt adjustment apparatus 61 includes a first electromagnetic switching valve 76 and a second electromagnetic switching valve 77.

The first electromagnetic switching valve 76 is provided in the middle of the pipe 66 through which the air reservoir (not illustrated) is connected to the leveling valve 41. The tilt control unit 313 controls the first electromagnetic switching valve 76 to be able to switch between a shut-off state and an open state of the flow path of the pipe 66.

The second electromagnetic switching valve 77 is provided in the middle of the pipe 68 through which the leveling valve 41 is connected to the air spring 31. Similar to the first electromagnetic switching valve 76, the tilt control unit 313 controls the second electromagnetic switching valve 77 to be able to switch between a shut-off state and an open state of the flow path of the pipe 68. Each of the first electromagnetic switching valve 76 and the second electromagnetic switching valve 77 referred to here can be configured as a 2-way electromagnetic switching valve, an electromagnetic shutoff valve, or the like. Similar to the first embodiment, the differential pressure valve 71 is attached to a pipe between two pipes 68.

Figure 15:
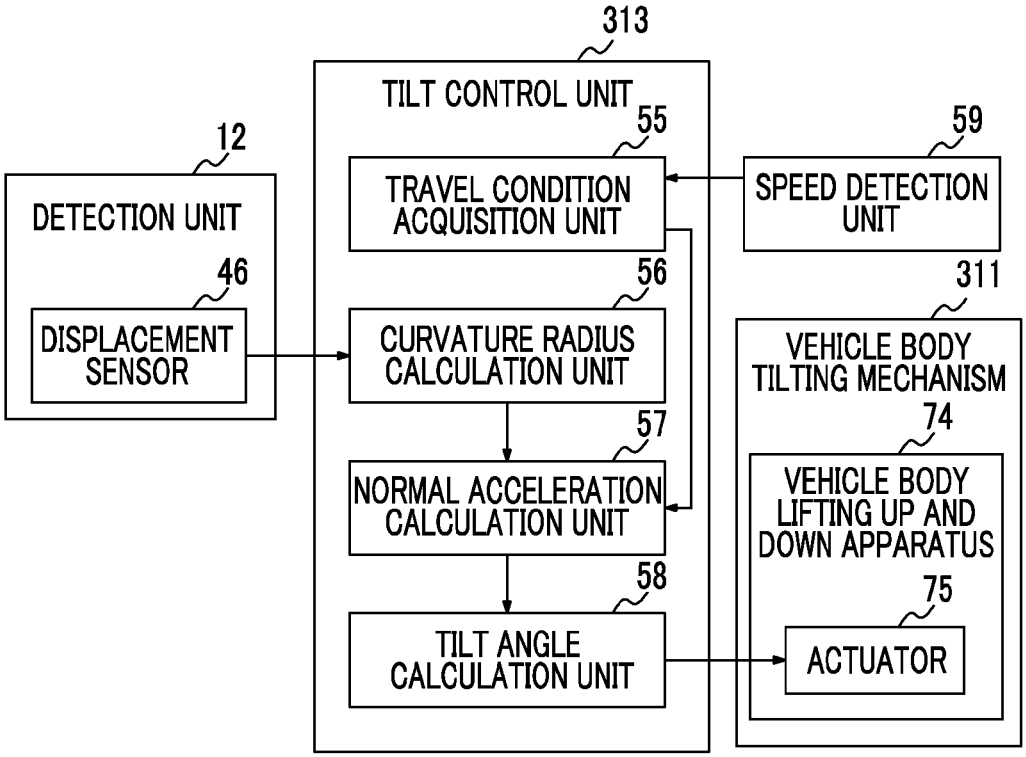
FIG. 15 is a hydraulic pressure circuit diagram in the embodiment, which is equivalent to FIG. 4.

As illustrated in FIG. 15, similar to the tilt control unit 13 in the first embodiment, the tilt control unit 313 includes the running condition acquisition unit 55; the curvature radius calculation unit 56; the normal acceleration calculation unit 57; and the tilt angle calculation unit 58. The car body tilting mechanism 311 controls expansion and contraction of the actuator 75 of each of the car body lifting up and down apparatus 74 based on a detection result from the tilt angle calculation unit 58, for example, based on expressions, tables, and maps, in such a manner that the detection result from the tilt angle calculation unit 58 coincides with the tilt angle of the car body 5.

Accordingly, similar to the guide-rail track vehicle in the second embodiment, during a normal operation of the guide-rail track vehicle of the third embodiment, it is possible to automatically control the height of the air spring 31 using the leveling valve 41 and the adjustment rod 45 such that the car body 5 is not brought into a tilted state. In contrast, in order to tilt the car body 5, it is possible to change a vertical support position in which the actuator 75 supports the bottom of the air spring 31 in a state where the leveling valve 41 is restricted from adjusting the height of the air spring 31. Accordingly, it is possible to adjust the height position of the car body 5 relative to the bogie frame 26 similar to when the height of each of the air springs 31 is individually adjusted. Accordingly, the heights of the end portions of the car body 5 in the vehicle lateral direction are set to be different from each other, and thus the car body 5 is tilted. As a result, it is possible to more reliably prevent ride quality from deteriorating when the guide-rail track vehicle travels on a curved portion of the track.

Subsequently, a guide-rail track vehicle in a fourth embodiment of the present invention will be described. Since the configuration of a car body tilting mechanism is the only difference between the guide-rail track vehicle 1 of the third embodiment and the guide-rail track vehicle 1 of the fourth embodiment, referring to FIG. 15, a description will be given with the same reference signs assigned to the same parts.

Figure 16:
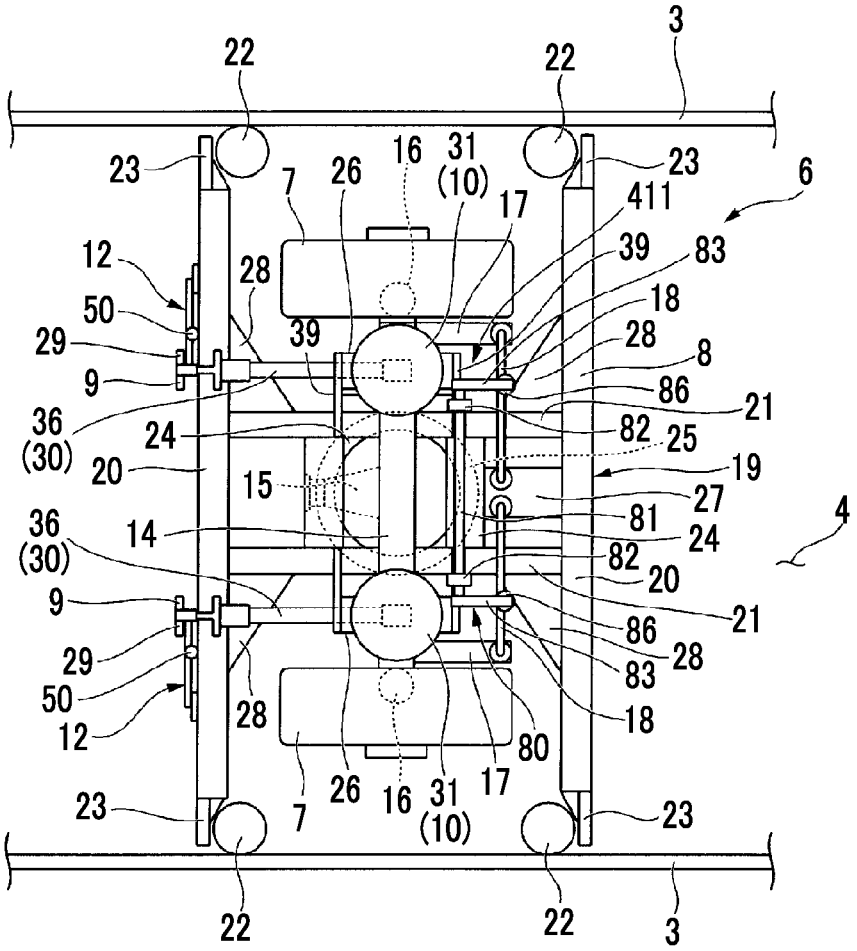
FIG. 16 is a plan view in a fourth embodiment of the present invention, which is equivalent to FIG. 1.
Figure 17:
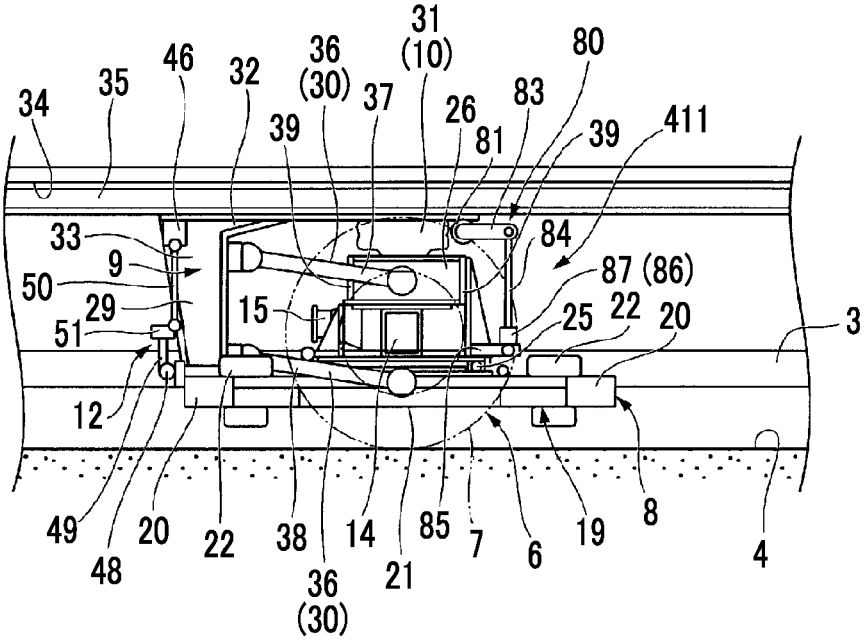
FIG. 17 is a side view in the embodiment, which is equivalent to FIG. 2.
Figure 18:
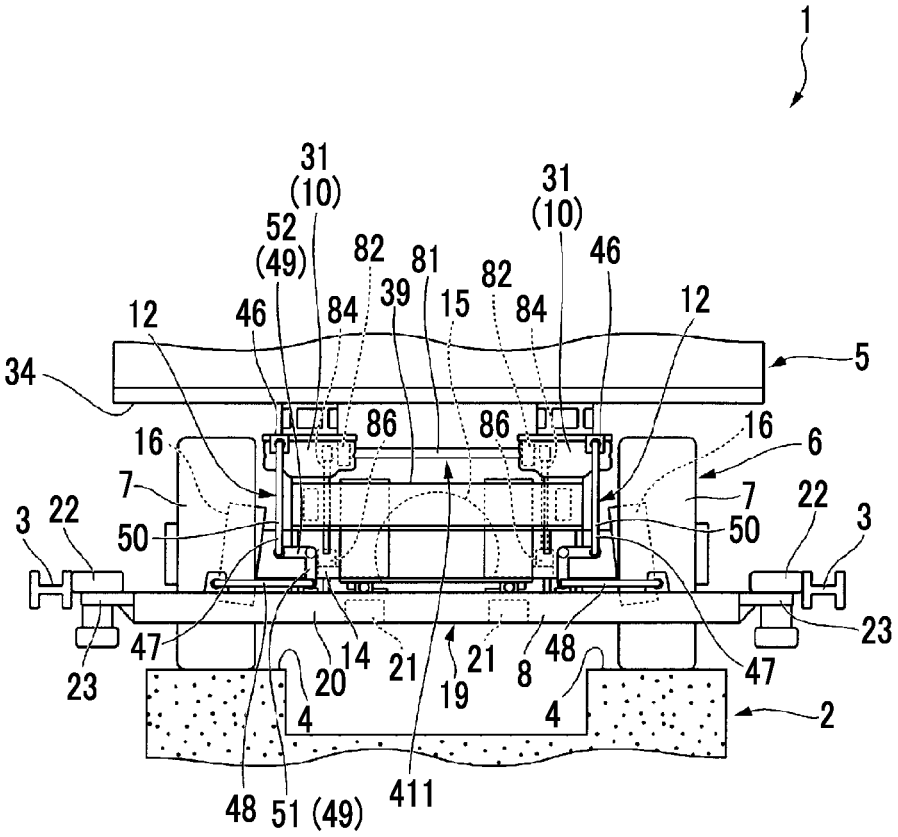
FIG. 18 is a front view in the embodiment, which is equivalent to FIG. 3.

As illustrated in FIGS. 16 and 18, the guide-rail track vehicle in the fourth embodiment includes the car body 5 and the bogie 6. The bogie 6 includes the travelling wheels 7; the steering device 8; the suspension apparatus 9; the dampening apparatus 10; a car body tilting mechanism 411; a detection unit 12; the tilt control unit 313 (refer to FIG. 15); and an anti-rolling apparatus 80. Since each of the travelling wheel 7, the steering device 8, the suspension apparatus 9, the dampening apparatus 10, the detection unit 12, and the tilt control unit 313 has the same configuration as that in the third embodiment, a detailed description thereof will be omitted. For illustrative purposes, FIGS. 16 to 18 do not illustrate the leveling valve 41 and the adjustment rod 45 which are configured to automatically adjust the height of the car body 5.

Similar to the first embodiment, the detection unit includes the displacement sensor 46 and the link portion 47, and detects the degree of turning of the guiding frame 19 after the degree of turning is converted into the amount of linear displacement of the vertical rod 50. The detection unit 12 is provided in each of the suspension frames 29 which are disposed while being separate from each other in the vehicle lateral direction. A detection result from the displacement sensor 46 is input to the tilt control unit 313.

The anti-rolling apparatus 80 has a torsion bar 81 extending in the vehicle lateral direction. The anti-rolling apparatus 80 restricts the tilting of the car body 5, in other words, a displacement in a rolling direction using a restoring force of the torsion bar 81 in a torsional direction. The opposite end portions of the torsion bar 81 are rotatably supported respectively by torsion bar rotation support bearing portions 82 attached to the car body 5. Each of the opposite end portions of the torsion bar 81 is provided with an arm portion 83 (refer to FIG. 17) extending in the longitudinal direction of the car body. An adjustment rod 84 extending downward is swingably attached to an end portion of the arm portion 83. A lower end portion of the adjustment rod 84 is swingably attached to an adjustment rod lower receiving portion 85 via an actuator 87 (to be described later). The adjustment rod lower receiving portion 85 is formed in such a manner so as to extend forward from the bogie frame 26 in the longitudinal direction of the car body.

The car body tilting mechanism 411 includes a rod expansion and contraction apparatus 86 and the tilt adjustment apparatus 61. The rod expansion and contraction apparatus 86 has an actuator 87.

The actuator 87 displaces a neutral position of the adjustment rod 84, in which a restoring force in the torsional direction does not occur. Specifically, the actuator 87 is configured as a linear motion mechanism that is expandable and contractable in the vertical direction, and can change the distance between the end portion of the arm portion 83 and an end portion of the adjustment rod lower receiving portion 85.

For example, when the car body 5 is displaced in the rolling direction in a state where the actuators 87 are in a non-operative state, an end portion of the arm portion 83, which is displaced downward due to the rolling of the car body 5, is lifted upward relative to the torsion bar 81 by the adjustment rod 84. Accordingly, the torsion bar 81 is twisted, a restoring force of the torsion bar 81 causes the end portion of the arm portion 83 to return downward relative to the torsion bar 81, and the end portion of the torsion bar 81 is displaced upward. That is, since the car body 5 is pressed upward by the torsion bar rotation support bearing portion 82 disposed close to the end portion of the torsion bar 81, the car body 5 is restricted from being tilted in the vehicle lateral direction.

For example, when the actuator 87 is operated in such a manner so as to increase the distance between the end portion of either one of the arm portions 83 in the vehicle lateral direction and the end portion of the associated adjustment rod lower receiving portion 85, the arm portion 83 swings upward. Accordingly, the torsion bar 81 is twisted, and a restoring force of the torsion bar 81 causes one lateral side of the torsion bar 81 to be displaced upward. At this time, the restoring force of the torsion bar 81 causes a compression force to be applied to one of the pair of air springs 31 which are disposed while being separate from each other in the vehicle lateral direction, and an expansion force to be applied to the other air spring 31. The air springs 31 are elastically deformed due to these forces, and the car body 5 is tilted in the vehicle lateral direction.

The tilt control unit 313 in the fourth embodiment is similar to that of the third embodiment in that the car body 5 is tilted by vertical expansion and contraction of a pair of the actuators 87 which are disposed while being separate from each other in the vehicle lateral direction. That is, since only the control target of the tilt control unit 313 in the fourth embodiment is changed from the "car body lifting up and down apparatus 74" illustrated in FIG. 15 to the "rod expansion and contraction apparatus 86", a detailed description thereof will not be given herein.

Accordingly, similar to the third embodiment, during a normal operation of the guide-rail track vehicle of the fourth embodiment, it is possible to automatically control the height of the air spring 31 using the leveling valve 41 and the adjustment rod 45 such that the car body 5 is not brought into a tilted state. In contrast, in order to tilt the car body 5, it is possible to change the neutral position of the torsion bar 81 by allowing the actuator 87 to twist the torsion bar 81 in a state where the leveling valve 41 is restricted from adjusting the height of the air spring 31. Accordingly, similar to when the height of each of the air springs 31 is individually adjusted, it is possible to adjust the height position of the car body 5 relative to the bogie frame 26. In addition, the heights of the end portions of the car body 5 in the vehicle lateral direction are set to be different from each other, and thus the car body 5 is tilted. As a result, it is possible to more reliably prevent ride quality from deteriorating when the guide-rail track vehicle travels on a curved portion of the track.

Subsequently, a guide-rail track vehicle in a fifth embodiment of the present invention will be described. Since part of a car body tilting mechanism is the only difference between the respective guide-rail track vehicles of the third embodiment and the fifth embodiment, a description will be given with the same reference assigned to the same parts.

Figure 19:
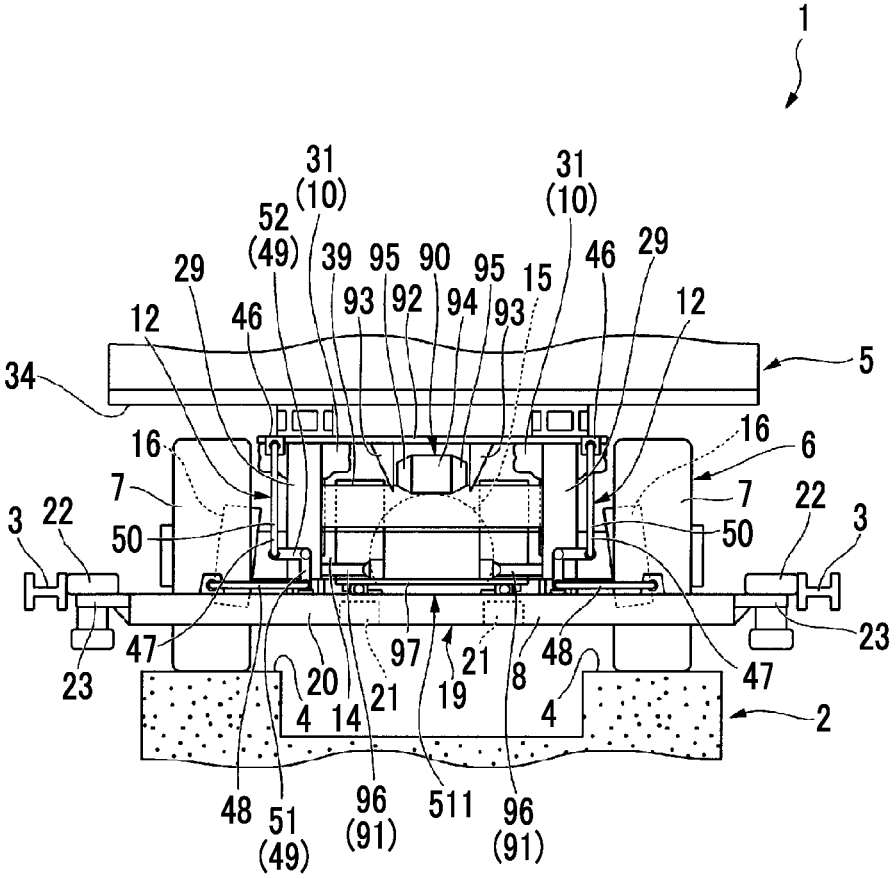
FIG. 19 is a front view in a fifth embodiment of the present invention, which is equivalent to FIG. 3.

As illustrated in FIG. 19, the guide-rail track vehicle in the fifth embodiment includes the car body 5 and the bogie 6. The bogie 6 includes the travelling wheels 7; the steering device 8; the suspension apparatus 9; the dampening apparatus 10; a car body tilting mechanism 511; a detection unit 12; and a tilt control unit 313. Since each of the travelling wheel 7, the steering device 8, the suspension apparatus 9, the dampening apparatus 10, the detection unit 12, and the tilt control unit 313 has the same configuration as that in the third embodiment, a detailed description thereof will be omitted. For illustrative purposes, FIG. 19 does not illustrate the leveling valve 41 and the adjustment rod 45 which are configured to automatically adjust the height of the car body 5.

Similar to the first embodiment, the detection unit includes the displacement sensor 46 and the link portion 47, and detects the degree of turning of the guiding frame 19 after the degree of turning is converted into the amount of linear displacement of the vertical rod 50. The detection unit 12 is provided in each of the suspension frames 29 which are disposed while being separate from each other in the vehicle lateral direction. A detection result from the displacement sensor 46 is input to the tilt control unit 313.

The car body tilting mechanism 511 includes a right/left stopper 90 and a car body tilting drive apparatus 91.

The right/left stopper 90 is disposed in a lateral center portion of a floor portion of the car body 5, and restricts the car body 5 from being slid relative to the bogie 6 in the vehicle lateral direction while allowing the car body 5 to be tilted relative to the bogie 6 in the vehicle lateral direction. The right/left stopper 90 includes a suspension-frame cross beam 92; a stopper receiver 93; a stopper rubber attachment receiver 94; and stopper rubbers 95.

The suspension-frame cross beam 92 is a flat plate-like member that is disposed while being suspended between the respective upper surfaces of the air springs 31. The stopper receiver 93 forms a pair of support surfaces which extends downward vertically from a lower surface of the suspension-frame cross beam 92 and faces each other.

The stopper rubber attachment receiver 94 is disposed between the support surfaces of the stopper receiver 93 in the vehicle lateral direction, and is fixed to a structure below a spring such as the bogie frame 26 or the gear box (not illustrated).

The stopper rubbers 95 are respectively attached to lateral outer surfaces of the stopper rubber attachment receiver 94, and each of the stopper rubbers 95 is disposed with a slight gap between the stopper receiver 93 and the stopper rubber 95. The stopper rubber 95 is preferably made of a material such as rubber or resin softer than the stopper receiver 93.

The car body tilting drive apparatus 91 applies force to the suspension frame 29 in the vehicle lateral direction. The car body tilting drive apparatus 91 includes a pair of actuators 96 and a turning bearing support portion 97.

The actuator 96 can expand and contract in the vehicle lateral direction based on a control command from the tilt control unit 313. A lateral outer end portion of the actuator 96 is coupled to a lower portion of the suspension frame 29. In contrast, a lateral inner end portion of the actuator 96 is supported by the turning bearing support portion 97.

The turning bearing support portion 97 is disposed while being suspended between the respective lower portions of the bogie frames 26, and is formed in such a manner so as to extend in the travel direction (a direction perpendicular to the sheet of FIG. 11).

That is, when one of the pair of actuators 96 expands, and the other actuator 96 contracts, the suspension frame 29 slides toward the other actuator 96 in the vehicle lateral direction. The stopper rubber 95 comes into contact with the stopper receiver 93. The suspension-frame cross beam 92 tilts about a tilt center (tilt fulcrum) at which the stopper rubber 95 comes into contact with the stopper receiver 93. Accordingly, one of the pair of air springs 31 disposed close to one of the actuators 96 is expanded, and the other air spring 31 disposed close to the other actuator 96 is compressed. As a result, a difference in height between the pair of air springs 31 occurs, and the car body 5 is tilted.

The tilt control unit 313 in the fifth embodiment is similar to that of the third embodiment in that the car body 5 is tilted by expansion and contraction of the pair of actuators 96 which are disposed while being separate from each other in the vehicle lateral direction. That is, since only the control target of the tilt control unit 313 in the fifth embodiment is changed from the "car body lifting up and down apparatus 74" illustrated in FIG. 15 to the "car body tilting drive apparatus 91", a detailed description thereof will not be given herein.

Accordingly, similar to the third embodiment, during a normal operation of the guide-rail track vehicle of the fifth embodiment, it is possible to automatically adjust the height of the air spring 31 using the leveling valve 41 and the adjustment rod 45 such that the car body 5 is not brought into a tilted state. In contrast, in order to tilt the car body 5, it is possible to change the height of each of the pair of air springs 31 by allowing the actuator 96 to press the suspension frame 29 in the vehicle lateral direction in a state where the leveling valve 41 is restricted from adjusting the height of the air spring 31. Accordingly, similar to when the height of each of the air springs 31 is individually adjusted, it is possible to adjust the height position of the car body 5 relative to the bogie frame 26. In addition, the heights of the end portions of the car body 5 in the vehicle lateral direction are set to be different from each other, and thus the car body 5 is tilted. As a result, it is possible to more reliably prevent ride quality from deteriorating when the guide-rail track vehicle travels on a curved portion of the track.

Subsequently, a guide-rail track vehicle in a sixth embodiment of the present invention will be described. Since a partial configuration of a guide-rail track vehicle is the only difference between the third embodiment and the sixth embodiment, a description will be given with the same reference assigned to the same parts. The guide-rail track vehicle in the sixth embodiment includes the car body 5 and the bogie 6, and the bogie 6 includes a pair of the travelling wheels 7; the steering device 8; the suspension apparatus 9; the dampening apparatus 10; the car body tilting mechanism 11; the detection unit 12; and a tilt control unit 413.

Figure 20:
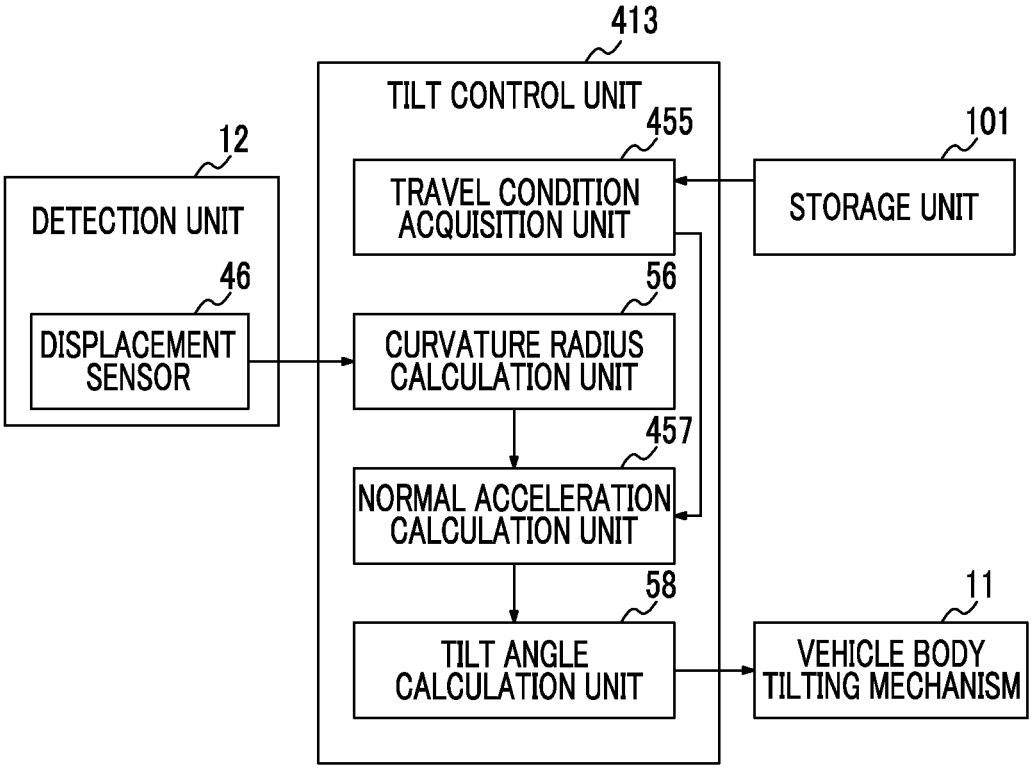
FIG. 20 is a block diagram in a sixth embodiment of the present invention, which is equivalent to FIG. 4.

As illustrated in FIG. 20, the guide-rail track vehicle in the sixth embodiment further includes a storage unit 101 in place of the speed detection unit 59 of the guide-rail track vehicle in the third embodiment.

The storage unit 101 pre-stores information regarding the cant of the track 2 and the vehicle speed. More specifically, the storage unit 101 pre-stores the shape of a route on which the guide-rail track vehicle travels, and a run curve.

The tilt control unit 413 controls the driving of the car body tilting mechanism 11 based on a detection result from the detection unit 12 and the information stored in the storage unit 101. The tilt control unit 413 includes a running condition acquisition unit 455; the curvature radius calculation unit 56; a normal acceleration calculation unit 457; and the tilt angle calculation unit 58.

The running condition acquisition unit 455 acquires information regarding the cant of the track 2 and the vehicle speed from information stored in the storage unit 101. Information regarding the cant and the vehicle speed referred to here is stored in association with travel position information on the track 2 or travel time information. That is, it is possible to acquire information regarding the cant and the vehicle speed corresponding to the travel position of the guide-rail track vehicle from the storage unit 101.

Similar to the curvature radius calculation unit 56 in the first embodiment, the curvature radius calculation unit 56 calculates the curvature radius of the track 2 using Expression (2) based on a detection result from the displacement sensor 46.

The normal acceleration calculation unit 457 calculates normal lateral acceleration applied to passengers in the vehicle based on information regarding a cant, a vehicle speed, and a curvature radius. Here, if the cant of a curve, the curvature radius, and the vehicle speed of the guide-rail track vehicle when rounding the curve are supposed to be "C" (%), "R" (m), and "V" (km/h), respectively, it is possible to obtain unbalanced centrifugal acceleration "αs" (G) using Expression (6) written below.

$$\alpha s=(V^2)/(127R)-C \tag{6}$$

In addition, the normal acceleration calculation unit 457 obtains the normal lateral acceleration "αp" (G) applied to the passengers when the guide-rail track vehicle rounds the curve using Expression (4).

The tilt angle calculation unit 58 calculates an optimal tilt angle required to tilt the car body 5 toward the inner rail when the vehicle rounds the curve using Expression (5). The tilt control unit 413 controls the car body tilting mechanism 11 to tilt the car body 5 based on the tilt angle calculated by the tilt angle calculation unit 58.

A description given hereinafter relates to an operation of the car body tilting mechanism 11 when the guide-rail track vehicle in the sixth embodiment travels on a curved portion of the track 2. The types of running conditions and an acquisition method are the only differences between the operation of the tilt control unit 413 in the sixth embodiment and the operation of the tilt control unit 13 in the first embodiment illustrated in FIG. 6. Accordingly, the description will be given with the same reference signs assigned to the same steps.

Figure 22:
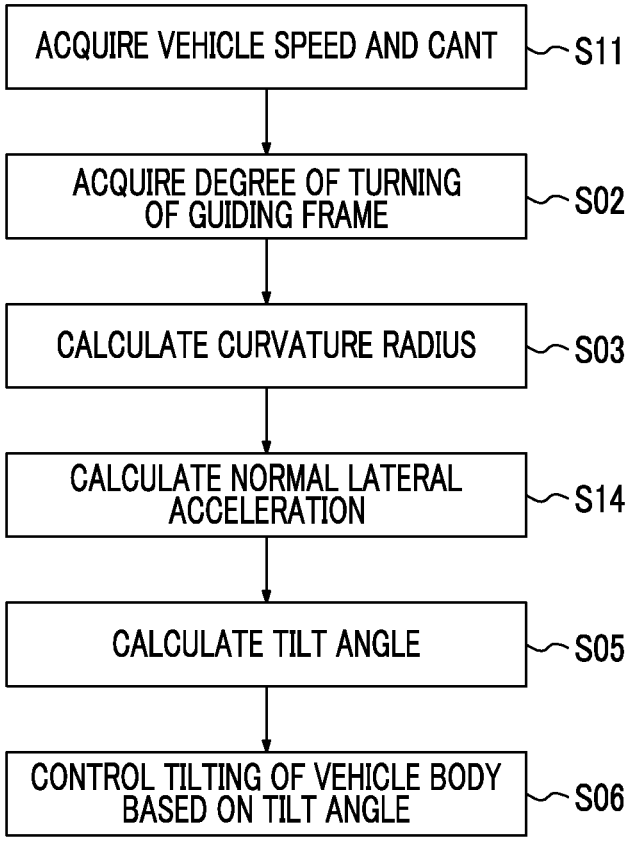
FIG. 22 is a flowchart in the sixth embodiment of the present invention, which is equivalent to FIG. 6.

As illustrated in FIG. 22, first, the tilt control unit 413 acquires information regarding the vehicle speed and the cant of the guide-rail track vehicle from the storage unit 101 via the running condition acquisition unit 55 (step S11). In parallel with this step, the tilt control unit 413 acquires the degree of turning of the guiding frame 19 detected by the displacement sensor 46 (step S02).

Subsequently, the tilt control unit 413 calculates the curvature radius of the track 2 from the degree of turning of the guiding frame 19 using the curvature radius calculation unit 56 (step S03).

The tilt control unit 413 obtains normal lateral acceleration applied to passengers in the vehicle calculated by the normal acceleration calculation unit 457 based on information regarding the vehicle speed, the cant, and the curvature radius (step S14).

Subsequently, the tilt control unit 413 obtains the lateral tilt angle of the car body 5 calculated by the tilt angle calculation unit 58 based on the normal lateral acceleration obtained by the normal acceleration calculation unit 457 (step S05).

The tilt control unit 413 controls the driving of the tilt drive unit 53 such that the tilt angle is equal to the calculated tilt angle (step S06).

Accordingly, in the guide-rail track vehicle of the sixth embodiment, it is possible to calculate the normal lateral acceleration, in which the cant of the track 2 is taken into consideration. For this reason, it is possible to calculate an optimal tilt angle required to tilt the car body 5 toward the inner rail when the vehicle rounds a curve.

Subsequently, a guide-rail track vehicle in a seventh embodiment of the present invention will be described. Since a partial configuration of a guide-rail track vehicle is the only difference between the third embodiment and the seventh embodiment, a description will be given with the same reference signs assigned to the same parts. The guide-rail track vehicle in the seventh embodiment includes the car body 5 and the bogie 6, and the bogie 6 includes a pair of the travelling wheels 7; the steering device 8; the suspension apparatus 9; the dampening apparatus 10; the car body tilting mechanism 11; the detection unit 12; and a tilt control unit 513.

The tilt control unit 513 controls the driving of the car body tilting mechanism 11 based on a detection result from the detection unit 12 and information stored in the storage unit 101.

Figure 21:
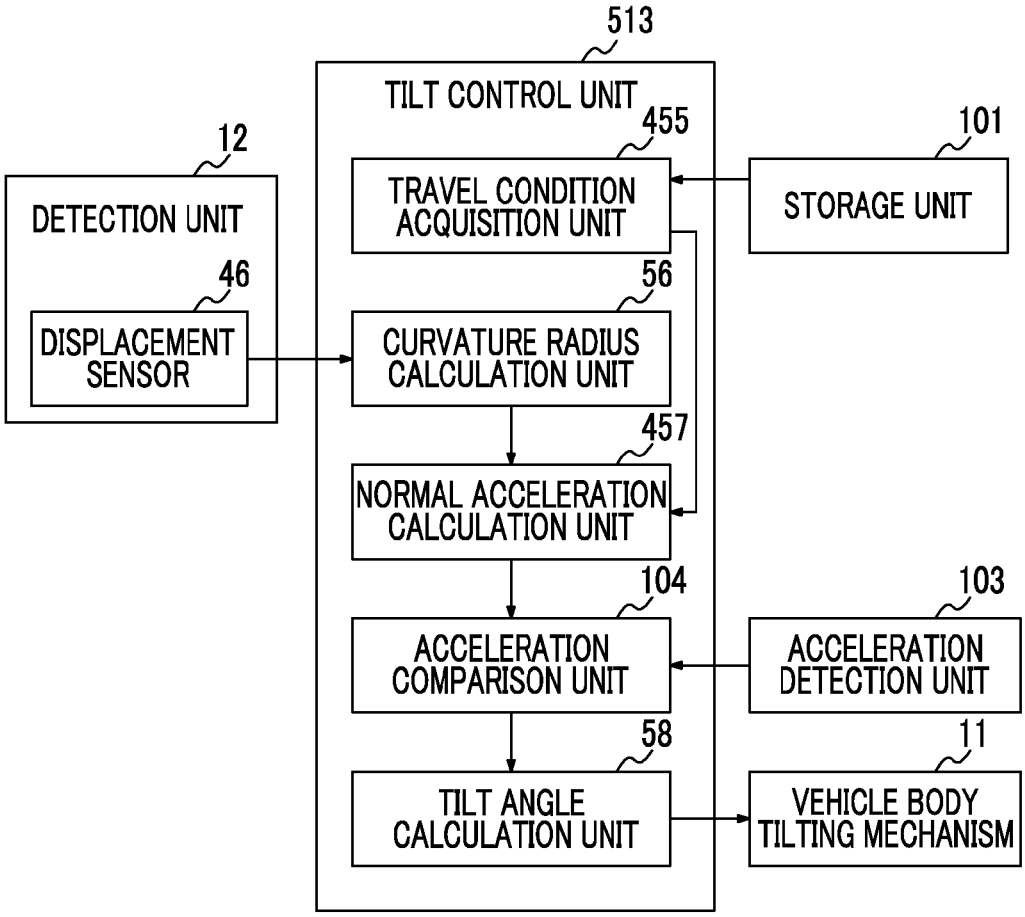
FIG. 21 is a block diagram in a seventh embodiment of the present invention, which is equivalent to FIG. 4.

As illustrated in FIG. 21, the guide-rail track vehicle in the seventh embodiment includes an acceleration detection unit 103. The acceleration detection unit 103 is attached to the car body 5, and detects normal lateral acceleration.

The tilt control unit 513 includes the running condition acquisition unit 455; the curvature radius calculation unit 56; the normal acceleration calculation unit 457; the acceleration comparison unit 104; and the tilt angle calculation unit 58. Since each of the running condition acquisition unit 455, the curvature radius calculation unit 56, and the normal acceleration calculation unit 457 has the same configuration as that in the sixth embodiment, a detailed description thereof will be omitted.

The acceleration comparison unit 104 compares a detection result from the acceleration detection unit 103 with a result calculated by the normal acceleration calculation unit 457. More specifically, the calculated result from the normal acceleration calculation unit 457 is verified by the detection result from the acceleration detection unit 103. For example, when a difference between the calculated result from the normal acceleration calculation unit 457 and the detection result from the acceleration detection unit 103 exceeds a pre-set threshold value, the acceleration comparison unit 104 determines that the calculated result from the normal acceleration calculation unit 457 indicates a failed state, and the tilting of the car body 5 is not controlled.

The tilt angle calculation unit 58 calculates an optimal tilt angle required to tilt the car body 5 toward the inner rail when the vehicle rounds a curve, using Expression (5). The tilt control unit 413 controls the car body tilting mechanism 11 to tilt the car body 5 based on a tilt angle calculated by the tilt angle calculation unit 58.

A description given hereinafter relates to an operation of the car body tilting mechanism 11 when the guide-rail track vehicle in the seventh embodiment travels on a curved portion of the track 2. Since an acceleration comparison step performed by the acceleration comparison unit 104 is the only differences between the operation of the tilt control unit 513 in the seventh embodiment and the operation of the tilt control unit 413 in the sixth embodiment, a description will be given with the same reference signs assigned to the same steps.

Figure 23:
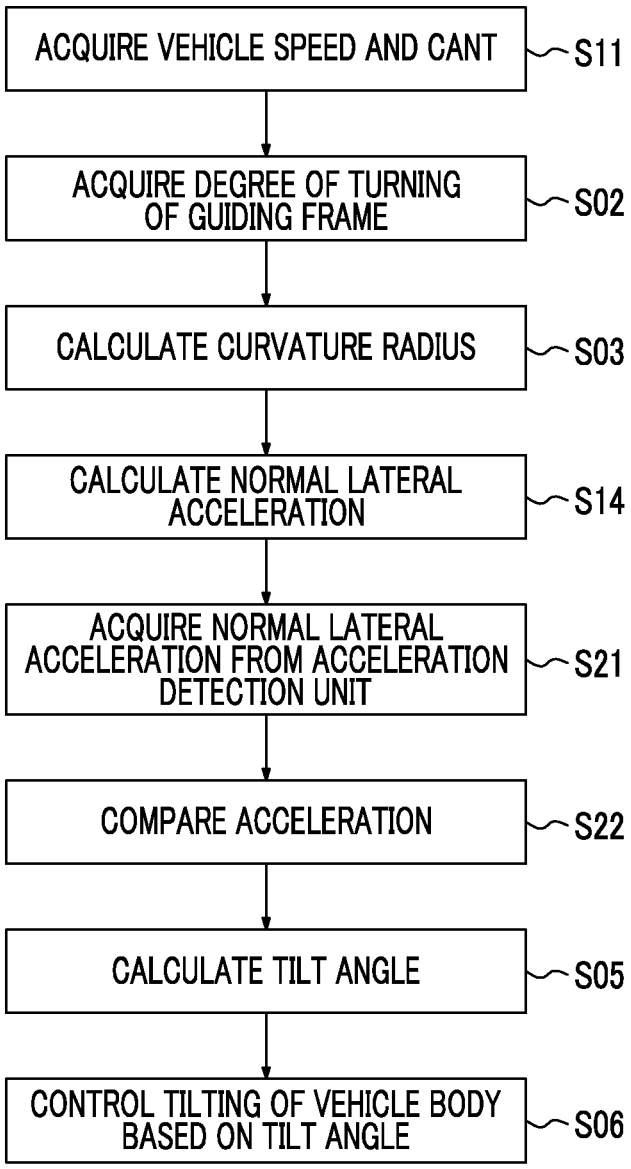
FIG. 23 is a flowchart in the seventh embodiment of the present invention, which is equivalent to FIG. 6.

As illustrated in FIG. 23, first, the tilt control unit 513 acquires information regarding the vehicle speed and the cant of the guide-rail track vehicle stored in the storage unit 101 via the running condition acquisition unit 55 (step S11). In parallel with this step, the tilt control unit 513 acquires the degree of turning of the guiding frame 19 detected by the displacement sensor 46 (step S02).

Subsequently, the tilt control unit 513 calculates the curvature radius of the track 2 from the degree of turning of the guiding frame 19 using the curvature radius calculation unit 56 (step S03).

The tilt control unit 513 obtains normal lateral acceleration applied to passengers in the vehicle calculated by the normal acceleration calculation unit 457 based on information regarding the vehicle speed, the cant, and the curvature radius (step S14).

The tilt control unit 513 acquires the normal lateral acceleration detected by the acceleration detection unit 103 (step S21: acceleration detection step and running condition acquisition step). The tilt control unit 513 controls the acceleration comparison unit 104 to compare the normal lateral acceleration calculated by the normal acceleration calculation unit 457 with the normal lateral acceleration detected by the acceleration detection unit 103 (step S22: acceleration comparison step). As described above, when the acceleration comparison unit 104 determines that a difference between the calculated result from the normal acceleration calculation unit 457 and the detection result from the acceleration detection unit 103 exceeds a pre-set threshold value, the acceleration detection unit 103 outputs information indicative of a failed state to the tilt angle calculation unit 58 such that the tilting of the car body 5 is not controlled.

Subsequently, when information regarding the normal lateral acceleration obtained by the normal acceleration calculation unit 457 is input to the tilt control unit 513 via the acceleration comparison unit 104, the tilt control unit 513 obtains the lateral tilt angle of the car body 5 calculated by the tilt angle calculation unit 58 based on the normal lateral acceleration (step S05). The tilt control unit 513 controls the driving of the tilt drive unit 53 such that the tilt angle is equal to the calculated tilt angle (step S06).

Accordingly, in the guide-rail track vehicle of the seventh embodiment, it is possible to detect normal lateral acceleration actually applied to passengers using the acceleration detection unit 103. For this reason, also when the value of the normal lateral acceleration calculated by the normal acceleration calculation unit 457 is abnormal, it is possible to detect the abnormality of the value and optimally control the tilting of the car body 5.

The present invention is not limited to the aforementioned embodiments, and various modifications can be made to the embodiments insofar as the modifications do not depart from the spirit of the present invention. That is, specific shapes, configurations, and the like illustrated in the embodiments are merely examples, and can be appropriately modified.

For example, in the description of the embodiments, the dampening apparatus 10 includes the air springs 31; however, the dampening apparatus 10 is not limited to the air spring 31 insofar as the dampening apparatus 10 can adjust the height of a car body. Two air springs 31 are disposed while being separate from each other in the vehicle lateral direction; however, the number of air springs 31 disposed in the vehicle lateral direction is not limited to two, and three or more air springs 31 may be disposed.

In the first embodiment, the tilt angle of the car body 5 is changed corresponding to the degree of turning of the guiding frame 19. However, when the curvature of a curved portion of the track 2 is greater than a predetermined curvature that is pre-set, the car body 5 may be tilted at only the predetermined angle that is pre-set. In this case, the detection unit 12 detects when the guide-rail track vehicle 1 enters the curved portion.

In the first embodiment, the vertical gap between the bogie frame 26 and the adjustment valve support bar 42 is displaced by the actuator 54; however, the present invention is not limited to this configuration. For example, the adjustment valve support bar 42 may be turned by the transmission of the rotating power of a motor to a rotary shaft of the adjustment valve support bar 42 via a speed reduction mechanism or the like.

In the embodiments, different types of the car body tilting mechanisms 11, 211, 311, and 411 are individually adopted. However, at least one of the car body tilting mechanisms 11, 211, 311, and 411 may be provided, or the car body 5 may be tilted by an appropriate combination thereof.

The curvature radius calculation unit 56 in each of the embodiments obtains a curvature radius using an expression; however, the present invention is not limited to this approach. For example, a curvature radius may be obtained referring to tables and maps relating to a detection result from the displacement sensor and the curvature radius.

Similarly, in the embodiments, the normal acceleration calculation units 57 and 457 obtain normal lateral acceleration using expressions, and the tilt angle calculation unit 58 obtains a tilt angle using an expression. However, the normal acceleration calculation units 57 and 457 may obtain normal lateral acceleration based on maps relating to a curvature radius, running conditions (vehicle speed, cant), and normal acceleration. The tilt angle calculation unit 58 may obtain the tilt angle of the car body 5 based on tables and maps relating to the normal lateral acceleration and the tilt angle.

In the embodiments, the degree of turning of the guiding frame 19 is converted into the amount of linear displacement, and then displacement sensor 46 detects the amount of converted linear displacement. However, a detection apparatus is not limited to the displacement sensor 46 insofar as the detection apparatus can detect the degree of turning. For example, the degree of turning of the guiding frame 19 may be detected by various detection apparatuses such as a rotary encoder, a variable resistor, and an image processing apparatus.

The sixth embodiment may include a tilt angle storage unit for storing information regarding a tilt angle. The tilt angle storage unit stores information regarding tilt angles which are pre-calculated by the tilt angle calculation unit 58 based on information regarding the shape of a route, a run curve, and the like stored in the storage unit 101. The tilt control unit 413 preferably controls the car body tilting mechanism 11 to tilt the car body 5 based on the tilt angles stored in the tilt angle storage unit.

In the embodiments, the cross beams 20 of the guiding frame 19 are disposed respectively in front of and behind the travelling wheels 7, and four guide wheels 22 are provided. However, the cross beam 20 may be disposed only in front of the travelling wheels 7. The guide wheels 22 are rotatably provided in the guiding frame 19; however, non-rotatable sliding members may be disposed in replacement of the guide wheels 22.

INDUSTRIAL APPLICABILITY

The present invention can be widely applied to a guide-rail track vehicle that is configured to be able to travel on a track while being guided by guide rails.

REFERENCE SIGNS LIST

1: guide-rail track vehicle
2: track
3: guide rail
4: travel path
5: car body
6: bogie
7: travelling wheel
8: steering device
9: suspension apparatus
10: dampening apparatus
11, 211: car body tilting mechanism
12: detection unit
13, 213, 313; 413, 513: tilt control unit
14: axle
15: drive apparatus
16: kingpin
17: steering arm
18: steering rod
19: guiding frame
20: cross beam
21: longitudinal beam
22: guide wheel
23: guide wheel support portion
24: bearing support portion
25: bearing
26: bogie frame
27: guiding frame coupling portion
28: reinforcement member
29: suspension frame
30: parallel link device
31: air spring
32: fixation portion
33: parallel link receiving portion
34: vehicle floor surface
35: car body underframe
36: parallel link
37: upper link member
38: lower link member
39: bogie frame
40: height adjustment apparatus
41: leveling valve
42: adjustment valve support bar
43: bracket
44: lever
45: adjustment rod
46: displacement valve
47: link portion
48: horizontal rod
49: horizontal detection link
50: vertical rod
51: first arm portion
52: second arm portion

53: tilt drive unit
54: actuator
55: running condition acquisition unit
56: curvature radius calculation unit
57: normal acceleration calculation unit
58: tilt angle calculation unit
59: speed detection unit
60: tilt angle controlling apparatus
61: tilt adjustment apparatus
62: pipe
63: first 3-way electromagnetic switching valve
64: second 3-way electromagnetic switching valve
65: bypass pipe
66: pipe
68: pipe
69: pipe
70: pressure sensor
71: differential pressure valve
74: car body lifting up and down apparatus
75: actuator
76: first electromagnetic switching valve
77: second electromagnetic switching valve
80: anti-rolling apparatus
81: torsion bar
82: torsion bar rotation support bearing portion
83: arm portion
84: adjustment rod
85: adjustment rod lower receiving portion
86: rod expansion and contraction apparatus
87: actuator
90: right/left stopper
91: car body tilting drive apparatus
92: suspension-frame cross beam
93: stopper receiver
94: stopper rubber attachment receiver
95: stopper rubber
96: actuator
97: turning bearing support portion
101: storage unit
103: acceleration detection unit

The invention claimed is:

1. A guide-rail track vehicle comprising:

a car body;

a bogie configured to support the bottom of the car body; and dampening apparatuses that are disposed between the bogie and the car body while being separate from each other in a vehicle lateral direction, wherein the bogie includes a car body tilting mechanism that has a drive unit and is configured to tilt the car body which has a first end in the vehicle lateral direction and a second end located opposite to the first end, wherein the drive unit is configured to lift the second end with respect to the first end;

a guiding frame configured to turn while being guided by guide rails provided along a track;

a detection unit that has a displacement sensor which is fixed to a floor surface of the car body or a suspension frame attached to the car body and a link mechanism which is configured to convert a displacement of the guiding frame in a turn direction into a displacement in a direction toward the displacement sensor, wherein the displacement sensor detects the displacement in the direction converted by the link mechanism, the detection unit is configured to detect the degree of turning of the guiding frame; and a tilt control unit that is configured to calculate a tilt angle of the car body based on a detection result from the displacement sensor, and that is configured to control a drive unit based on the tilt angle.

2. The guide-rail track vehicle according to claim 1, wherein the link mechanism includes:

a horizontal rod which is coupled to a cross beam of the guiding frame so as to extend in the vehicle lateral direction, and which is configured to be capable of swinging with respect to the guiding frame, a horizontal detection link which is configured to be capable of swinging with respect to the horizontal rod, and which is supported by the car body so as to be capable of turning about an axial line extending in a longitudinal direction of the car body, and a vertical rod which is configured to be capable of swinging with respect to the horizontal detection link, and which is formed to extend in a vertical direction; and wherein the displacement sensor is configured to detect an amount of a vertical displacement of the vertical rod as a linear displacement.

3. The guide-rail track vehicle according to claim 1, further comprising:

a height adjustment apparatus configured to be able to individually adjust the height of each of the dampening apparatuses; and an automatic height adjustment mechanism configured to maintain the height of the dampening apparatus in a pre-set range of height by operating the height adjustment apparatus, wherein the car body tilting mechanism includes a height adjustment apparatus moving mechanism configured to be able to move the height adjustment apparatus in a height direction, and a drive apparatus configured to drive the height adjustment apparatus moving mechanism, and wherein the tilt control unit controls the driving of the drive apparatus based on a detection result from the detection unit, and moves the position, of the height adjustment apparatus in the height direction using the height adjustment apparatus moving mechanism.

4. The guide-rail track vehicle according to claim 1, further comprising:

a height adjustment apparatus configured to be able to individually adjust the height of each of the dampening apparatuses; and an automatic height adjustment mechanism configured to maintain the height of the dampening apparatus in a pre-set range of height by operating the height adjustment apparatus, wherein the car body tilting mechanism includes a tilt angle control apparatus that is configured to change the height of the dampening apparatus while bypassing the height adjustment apparatus, when tilting the car body, and a tilt adjustment apparatus configured to restrict the height adjustment apparatus from adjusting the height of the dampening apparatus, and wherein the tilt control unit controls the driving of the tilt angle control apparatus based on a detection result from the detection unit such that the height of the dampening apparatus is adjusted.

5. The guide-rail track vehicle according to claim 1, further comprising:

a height adjustment apparatus configured to be able to individually adjust the height of each of the dampening apparatuses; and an automatic height adjustment mechanism configured to maintain the height of the dampening apparatus in a pre-set range of height by operating the height adjustment apparatus, wherein the car body tilting mechanism includes a car body lifting up and down apparatus that is configured to support the bottom of the dampening apparatus and to be able to move the position of the dampening apparatus in a vertical direction, and a tilt adjustment apparatus configured to restrict the height adjustment apparatus from adjusting the height of the dampening apparatus, and wherein the tilt control unit controls the car body lifting up and down apparatus to displace the position of the dampening apparatus in the vertical direction based on a detection result from the detection unit.

6. The guide-rail track vehicle according to claim 5, wherein the car body tilting mechanism includes a right/left stopper that is disposed in a lateral center portion of the floor portion of the car body and is configured to restrict the car body from being slid in the vehicle lateral direction while allowing the car body to be tilted in the vehicle lateral direction, and a car body tilting drive apparatus configured to apply force to the suspension frame in the vehicle lateral direction, and wherein the till control unit controls the driving of the car body tilting drive apparatus based on a detection result from the detection unit such that force is applied to the suspension frame in the vehicle lateral direction.

7. The guide-rail track vehicle according to claim 1, further comprising:

an anti-rolling apparatus that is configured to include a torsion bar extending in the vehicle lateral direction, and to restrict the tilting of the car body using a restoring force of the torsion bar in a torsional direction, wherein the car body tilting mechanism includes a rod expansion and contraction apparatus configured to displace a neutral position of the torsion bar in the torsional direction, and wherein the tilt control unit controls the driving of the rod expansion and contraction apparatus based on a detection result from the detection unit such that the neutral position of the torsion bar is displaced.

8. The guide-rail track vehicle according to claim 1, wherein the tilt control unit includes a running condition acquisition unit configured to acquire at least vehicle speed information as a running condition;

a curvature radius calculation unit configured to calculate the curvature radius of the track based on the degree of turning detected by the detection unit;

a normal acceleration calculation unit configured to obtain normal lateral acceleration applied to passengers in the vehicle based on the vehicle speed information and the curvature radius; and a tilt angle calculation unit configured to calculate the lateral tilt angle of the car body based on the normal lateral acceleration.

9. The guide-rail track vehicle according to claim 8, further comprising:

a speed detection unit configured to detect a vehicle speed, wherein the running condition acquisition unit acquires vehicle speed information from the speed detection unit, and wherein the normal acceleration calculation unit calculates normal lateral acceleration based on information regarding the vehicle speed and the curvature radius.

10. The guide-rail track vehicle according to claim 8, further comprising:

a storage unit configured to pre-store information regarding the cant of the track and the vehicle speed, wherein the running condition acquisition unit acquires information regarding the cant and the vehicle speed from information stored in the storage unit, and wherein the normal acceleration calculation unit calculates normal lateral acceleration based on information regarding the cant, the vehicle speed, and the curvature radius.

11. The guide-rail track vehicle according to claim 10, further comprising:

an acceleration detection unit configured to detect normal lateral acceleration, wherein the running condition acquisition unit acquires information regarding the normal lateral acceleration detected by the acceleration detection unit, and wherein the tilt control unit includes an acceleration comparison unit that is configured to compare the normal lateral acceleration calculated by the normal acceleration calculation unit with the normal lateral acceleration detected by the acceleration detection unit.

12. A car body tilt control method of a guide-rail track vehicle including a car body, a bogie configured to support the bottom of the car body, and dampening apparatuses that are disposed between the bogie and the car body while being separate from each other in a vehicle lateral direction, wherein the bogie includes:

a car body tilting mechanism that has a drive unit and is configured to tilt the car body which has a first end in the vehicle lateral direction and a second end located opposite to the first end, wherein the drive unit is configured to lift the second end with respect to the first end;

a guiding frame configured to turn while being guided by guide rails provided along a track;

a detection unit that has a displacement sensor which is fixed to a floor surface of the car body or a suspension frame attached to the car body and a link mechanism which is configured to convert a displacement of the guiding frame in a turn direction into a displacement in a direction toward the displacement sensor, wherein the displacement sensor detects the displacement in the direction converted by the link mechanism, the detection unit is configured to detect the degree of turning of the guiding frame; and a tilt control unit that is configured to calculate a tilt angle of the car body based on a detection result from the displacement sensor, and is configured to control a drive unit based on the tilt angle, the method comprising: a detection step of detecting the degree of turning of the guiding frame; and a tilt control step of controlling the tilting of a car body based on the degree of turning of the guiding frame.

13. The car body tilt control method of a guide-rail track vehicle according to claim 12, wherein the tilt control step includes a running condition acquisition step of acquiring at least vehicle speed information as a running condition;

a curvature radius calculation step of calculating the curvature radius of the track based on the degree of turning of the guiding frame;

a normal acceleration calculation step of obtaining normal lateral acceleration applied to passengers in the vehicle based on the vehicle speed and the curvature radius; and a tilt angle calculation step of calculating the lateral tilt angle of the car body based on the normal lateral acceleration, and wherein the tilting of the car body is controlled in such a manner that the tilt angle is equal to the calculated tilt angle.

14. The car body tilt control method of a guide-rail track vehicle according to claim 13, wherein information regarding a cant and the vehicle speed is acquired in the running condition acquisition step, and wherein the normal lateral acceleration is calculated based on the cant, the vehicle speed, and the curvature radius in the normal acceleration calculation step.

15. The car body tilt control method of a guide-rail track vehicle according to claim 14, further comprising:

an acceleration detection step of detecting normal lateral acceleration, wherein information regarding the normal lateral acceleration detected in the acceleration detection step is acquired in the running condition acquisition step, and wherein the tilt control step includes an acceleration comparison step of comparing the normal lateral acceleration calculated in the normal acceleration calculation step with the normal lateral acceleration detected in the acceleration detection step.

* * * * *